US011672741B2

(12) United States Patent
Davis et al.

(10) Patent No.: US 11,672,741 B2
(45) Date of Patent: Jun. 13, 2023

(54) PACIFIER

(71) Applicant: John J. Davis, Troutville, VA (US)

(72) Inventors: John J. Davis, Troutville, VA (US); Justin H. Smart, Chandler, AZ (US); Richard L. D'Aloisio, Tempe, AZ (US)

(73) Assignee: John J. Davis, Troutville, VA (US)

( * ) Notice: Subject to any disclaimer, the term of this patent is extended or adjusted under 35 U.S.C. 154(b) by 725 days.

(21) Appl. No.: 16/577,494

(22) Filed: Sep. 20, 2019

(65) Prior Publication Data

US 2020/0009019 A1 Jan. 9, 2020

Related U.S. Application Data

(63) Continuation-in-part of application No. PCT/US2018/024270, filed on Mar. 26, 2018.

(60) Provisional application No. 62/645,524, filed on Mar. 20, 2018, provisional application No. 62/519,479, filed on Jun. 14, 2017, provisional application No. 62/477,120, filed on Mar. 27, 2017.

(51) Int. Cl.
*A61J 17/00* (2006.01)

(52) U.S. Cl.
CPC ..... *A61J 17/001* (2015.05); *A61J 17/113* (2020.05); *A61J 17/107* (2020.05)

(58) Field of Classification Search
CPC ..... A61J 17/001; A61J 17/107; A61J 17/113; A61J 17/02; A61J 17/10; A61J 17/105
See application file for complete search history.

(56) References Cited

U.S. PATENT DOCUMENTS

| | | | |
|---|---|---|---|
| 4,768,510 | A | 9/1988 | Leung |
| 5,700,279 | A | 12/1997 | Blando |
| 6,197,044 | B1 | 3/2001 | Clayton |
| 6,695,869 | B2 | 2/2004 | Fitzpatrick et al. |
| 7,029,491 | B2 | 2/2006 | Davis |
| D691,277 | S | 10/2013 | Mccarty |
| D748,811 | S | 2/2016 | Lee |
| 9,855,194 | B1 | 1/2018 | Walter, Jr. |

(Continued)

OTHER PUBLICATIONS

Nookums Paci-Plushies Pacifier Holders & Teethers, URL: <https://www.paciplushies.com/collections/paci-plushies-pacifier-replacements/products/nookums-one-piece-pacifer>, retrieved from the Internet Apr. 2, 2018.

(Continued)

*Primary Examiner* — Majid Jamialahmadi
(74) *Attorney, Agent, or Firm* — Vorys, Sater, Seymour and Pease LLP

(57) ABSTRACT

Uni-molded pacifier includes nipple, stem, shield and typically a handle. The stem includes a round surface, as in classically designed pacifiers, or may be orthodontically shaped, extending proximally and longitudinally into a base which in turn is blended into a shield. Change in the base to stem contact angle lowers the applied force to the stem as compared to traditional pacifier stems and bases. The decrease in applied force to the stem equates to less pressure needed to compress the stem thru sucking activity. The shield, in this uni-molded pacifier, also has an increase in the area and mass of the center surface. This decreases diameter of the posterior mouth of the shield opening to a lumen of the base and stem which has an added benefit to make it more difficult for debris to enter the lumen. If desired there is no posterior mouth.

25 Claims, 25 Drawing Sheets

(56) References Cited

U.S. PATENT DOCUMENTS

| | | | | |
|---|---|---|---|---|
| 2002/0055760 | A1 | 5/2002 | Avital | |
| 2003/0083696 | A1 | 5/2003 | Avital | |
| 2009/0312796 | A1 | 12/2009 | Itzek et al. | |
| 2010/0312276 | A1 | 12/2010 | Schofield et al. | |
| 2012/0053632 | A1 | 3/2012 | Tirosh | |
| 2014/0221917 | A1* | 8/2014 | Oates, II | A61J 7/0053 604/79 |

OTHER PUBLICATIONS

HEVEA Pacifier (orthodontic stem) photograph, Dec. 2017.
HEVEA Pacifier (round stem) photograph, Dec. 2017.
Natursutten, Natural Pacifier, photograph, Dec. 2017.
Nookums pacifier, Packaging and photographsNookums LLC, Apr. 7, 2018.
International Search Report dated Jun. 11, 2018 for PCT/US2018/024270 to John J. Davis filed Mar. 26, 2018.

* cited by examiner

PACIFIER

CROSS-REFERENCE TO RELATED APPLICATIONS OF THE INVENTION

This is a continuation-in-part of Patent Cooperation Treaty patent application no. PCT/US2018/024270, having an international filing date of Mar. 26, 2018, which claims the benefit of U.S. provisional patent application No. 62/519,479, filed Jun. 14, 2017, U.S. provisional patent application No. 62/477,120, filed Mar. 27, 2017, and U.S. provisional patent application No. 62/645,524, filed Mar. 20, 2018, all incorporated herein by reference in their entirety.

FIELD OF THE INVENTION

The principal utility of the invention relates to pacifiers for infants who still have the natural sucking instinct or urge.

BACKGROUND OF THE INVENTION

From birth, infants have a natural sucking instinct or urge. This phenomenon is essential for the infant's survival, for it allows them to feed from the infant's mother's breast a short time following birth. However, if the sucking urge is not gratified, the infant will generally have a remaining urge that may lead either to frustration if the urge is not satisfied or the infant will lose the urge. A common practice to ease the frustration of the sucking urge is for the infant to engage in a non-nutritional sucking where the infant will suck a thumb, finger, or pacifier. Such acts may satisfy the urge. As a result of the satisfaction, such acts may provide a source of pleasure, self-gratification, comfort, and soothing relaxation. As the infant grows, the sucking urge is gradually replaced by mastication.

The use of a pacifier as a means to satisfy the sucking urge has been used for many centuries. In early pacifiers, the pacifiers were made of a cloth or chamois into which bread crumbs or sugar were placed and then were tied into the shape of a nipple. The end would be moistened and introduced in the infant's mouth. These simple devices over the years have evolved into the modern day pacifier.

A problem associated with the use of these pacifiers is that after prolonged use, they begin to affect the development of or change the structure of the infant's oral cavity. Without the pacifier, thumb, finger, etc. in the mouth, the tongue naturally exerts a positive pressure in the mouth, namely a pressure pushing out against the alveolar ridges and the teeth. Such positive pressure spurs an increase in inter-canine and inter-molar distance growth, as well as spurring expansion of the width of the alveolar ridges.

When an infant sucks on one of these pacifiers, the top of the pacifier conforms to the roof of the infant's dentition and palate, causing negative and positive pressure that is directed towards the dentition and the roof of the child's mouth or palate. As the tongue moves upward during a sucking action, the nipple is compressed between the tongue, dentition, and palate, creating a positive pressure between them. This pressure has an adverse effect on the inter-canine and inter-molar growth, causing them to move toward the centerline of the palate and preventing the palate's natural growth outward, which can cause a cross bite, meaning the upper teeth bite on the inside of the lower teeth. This pressure can also cause the alveolar ridge, which generally has a horse shoe shape, to have a narrower width than normal. These adverse effects can overcome the natural growth caused by positive pressure from the tongue.

When the stem of the pacifier is compressed by the upper and lower incisors by biting down on the stem, pressure is exerted superiorly to the upper incisors which intrudes them resulting in an open bite and can also cause an increase in the overjet, or increase in horizontal discrepancy between the upper and lower anterior dentition.

US Patent Application Publication No. 2010/0312276 A1 to Schofield et al discloses a soother comprising a teat and a shield is constructed by co-moulding the teat and the shield and over-moulding the teat material on the shield material. However, it has no open pacifier mouth having a mouth diameter smaller than a largest transverse dimension of an internal surface of a cavity in a neck of the nipple.

US Patent Application Publication No. 2012/0053632 A1 to Tirosh et al discloses a multi-piece pacifier for a baby of the type having a rigid shield, further comprising: a nipple; and a plug for securing the nipple to the rigid shield. The pacifier comprises a shock absorbing feature disposed on an outer facing portion of the pacifier, for absorbing a shock in the event that the baby falls forward. In exemplary embodiments, the shock absorbing feature comprises a resilient member disposed between a plug base and plug head; a resilient loop-shaped member; or a pillow-like member. However, the pacifier has no open pacifier mouth. In other words, there is no mouth available to be touched by the baby. The back end of the pacifier is closed.

SUMMARY OF THE INVENTION

It is therefore an object of the invention to provide a pacifier that avoids the problems mentioned above. The invention provides a uni-molded pacifier which includes a nipple, stem, and shield and preferably a handle.

These and other objects obvious to a person having ordinary skill in the art are overcome in a pacifier comprising a nipple having a flat or round stem portion, which makes contact with the base at a 55 degree or greater line angle. The nipple is made of a resilient or elastic compressible material. Preferably it is made of, plastic, medical grade rubber, silicone rubber, latex or other conventional pacifier material. Preferably the pacifier material does not contain Bisphenol-A. By plastic it is meant a material that is compounded and can be processed by flow.

Thus, the nipple can be of any suitable shape. A round stem characterizes a non-orthodontically designed nipple and a flat stem represents an orthodontically shaped nipple. FIG. 3 shows a classically shaped round nipple having a posterior neck and a distal head end portion that is bulbous. A flat stem refers to an orthodontic shaped nipple or physiologically shaped nipple having a posterior neck and a distal head end portion. For example, it can be orthodontically shaped as in U.S. Pat. No. 7,029,491 to Davis, incorporated herein by reference, or any other orthodontically shaped nipple.

Alternatively, the stem may invert into the base and mate to the base at a negative line angle, relative to the outer surface of the superior height of the base in relation to the most proximal end of the stem. The distal end goes furthest into the baby's mouth.

The current (prior art) design of uni-molded pacifiers incorporates a hollow mouth at the central posterior surface of the shield which has internal dimensions relatively equal to that of the largest diameter of the lumen of the base to allow the ease of the removal of the core during the molding process. The core is the part of a mold device that produces the internal cavity in the molded product.

The improved shield design incorporates a much smaller mouth, relative to the largest dimension of the internal surface of the base, and thus, greater central mass and surface area that act to increase the stiffness of the shield and to limit the ingress of dirt and debris. If the base is cylindrical the largest dimension of the internal surface of the base is the largest diameter of the lumen of the base. The mouth is posterior to the base. In this specification the anterior end is the tip of the nipple and the posterior end is the opposite end. The posterior end is the posterior surface of the shield when the shield has no posterior handle. The posterior end is the posterior end of the posterior handle when the shield has a posterior handle.

A trough may be incorporated into the shield design such that it entirely surrounds the mouth of the shield, and acts as an area of stress relief for removal of the core.

The shield may or may not have a trough depending on the molding process and the wall thickness in the area around the mouth to the lumen of the base.

The shield may also have a smaller mouth, where it opens into a funnel, which communicates into the lumen of the stem and serves to limit the ingress of dirt and debris, but will not increase the stiffness of the shield. A trough encircles the outer perimeter of the mouth and funnel.

The improved shield design, with the smaller mouth relative to the largest dimension of the internal surface of the base, may be achieved by the surrounding area of the mouth being a part of the shield proper or may be constructed by adding a partition (also termed in this specification as a blocking wall, partition wall, disc shaped partitioning insert, an annular partition, a disc, or a generally disc shaped member), typically having an annular shape, defining the smaller mouth therein that would be manufactured and then connected to the shield. The partition may be made of similar material as that of the pacifier or may be made of another material such as a hard plastic. The partition may be connected via multi shot insert molding, co-molding, sonic welding (also known as ultrasonic welding), gluing, or a snap fit assembly. The partition may be incorporated into the shield or may be connected and incorporated into a circular handle extending from the shield posterior. Or the partition may be partially connected to the shield or to the circular handle extending from the shield posterior.

The invention provides a pacifier comprising:

a shield, a base, and a nipple, the nipple comprising a stem for insertion into an infant's mouth and a closed distal end, the stem having longitudinal sidewalls, the shield, the base, and the nipple being longitudinally aligned, the base extending longitudinally from the shield, the nipple extending longitudinally from the base;

the base having a top wall, the top wall of the base having a slope line which intersects a longitudinal axis of the stem at an angle β (beta) of 55 to 120 degrees;

wherein the nipple, base, and shield define a hollow lumen comprising a nipple portion of the lumen, a base portion of the lumen, and a shield portion of the lumen. The angle β (beta) is defined as the angle on the right hand side of a longitudinal axis of the pacifier below a slope line of the top wall of the base of the pacifier as viewed when facing the pacifier with its nipple oriented upwardly.

The angle β (beta) may be in the range of 55 to 120 degrees, preferably 75 to 110 degrees, more preferably 80 to 100 degrees, further more preferably 85 to 100 degrees, further more preferably greater than 90 degrees (e.g. 91 or 92) to at most 100 degrees. A desired angle β is about 90 degrees±2 degrees. In contrast, conventional pacifiers typically have an angle β of about 45 degrees.

The pacifier nipple extends from the base, wherein the base extends from the shield, wherein the nipple, base, and shield define a hollow lumen comprising a nipple portion of the lumen, a base portion of the lumen, and a shield portion of the lumen, and preferably the shield defines a shield mouth on the posterior surface of the shield, the mouth having a mouth diameter smaller than an internal diameter of the base portion of the lumen. The shield has a posterior wall comprising the posterior surface. The shield posterior wall may have a trough that circumferentially surrounds the shield mouth.

If desired the posterior surface of the shield opens into a funnel shaped conduit and is circumferentially encompassed by a trough.

The invention also includes a pacifier comprising a shield, a base, and a nipple, wherein the nipple extends longitudinally from the base, wherein the base extends longitudinally from the shield, wherein the base extends transversely from the nipple, wherein the nipple, base, and shield define a hollow lumen comprising a nipple portion of the lumen, a base portion of the lumen, and a shield portion of the lumen, wherein the base portion of the lumen defines internal surface of the base, wherein the shield has a posterior surface, and wherein the pacifier defines a pacifier mouth posterior to the nipple, the pacifier mouth having a mouth largest transverse dimension smaller than a largest transverse dimension of the internal surface of the base. The pacifier mouth being an opening in the pacifier.

The invention also includes a pacifier comprising a shield, a base, and a nipple, wherein the nipple extends longitudinally from the base, wherein the base extends longitudinally from the shield, wherein the nipple, base, and shield define a hollow lumen comprising a nipple portion of the lumen, a base portion of the lumen, and a shield portion of the lumen, wherein the base portion of the lumen defines internal surface of the base, and wherein the pacifier defines a mouth posterior to the base, the mouth having a mouth largest transverse dimension, typically a diameter, smaller than a largest transverse dimension of the internal surface of the base. The use of the term diameter in this specification does not require the mouth to be a circular opening, although typically the mouth is a circular opening. A diameter is a straight line passing from side to side through the center of a body or figure, especially but not necessarily a circle. Thus, it is equivalent to mouth largest transverse dimension.

Thus, this pacifier has at least one mouth (also termed a shield, rear or posterior mouth) which is posterior to the base, each shield mouth having a mouth diameter smaller than an internal diameter of the base portion of the lumen and in communication with the hollow lumen.

Preferably this provides a pacifier comprising a shield, a base, and a nipple, wherein the nipple extends longitudinally from the base, wherein the base extends longitudinally from the shield, wherein the base extends transversely from the nipple, wherein the nipple, base, and shield define a hollow lumen comprising a nipple portion of the lumen, a base portion of the lumen, and a shield portion of the lumen, and wherein the pacifier defines a mouth posterior to the base, the mouth having a mouth largest transverse dimension (typically a diameter) smaller than a largest transverse dimension (typically a diameter) of the internal surface of the base.

The pacifier may comprise the shield having a posterior wall comprising the posterior surface, the shield posterior wall having a trough that circumferentially surrounds the shield mouth. The posterior surface of the shield may open into a funnel shaped conduit and is circumferentially encompassed by a trough.

The pacifiers of the invention may have a handle which is a hollow elongated handle having continuous sidewalls defining a handle portion of the hollow lumen, wherein the continuous sidewalls have a continuous perimeter, wherein the hollow elongated handle extend posteriorly from the shield, wherein the hollow elongated handle is integral with the shield, wherein the handle portion of the hollow lumen is aligned with the mouth, wherein the hollow elongated handle has an open posterior end.

Typically the pacifiers of the invention may have a handle which is circular and circumferentially surrounds the mouth.

The shield of the pacifiers of the invention may have a posterior surface, wherein the shield defines at least one said mouth posterior to the base on the posterior surface of the shield.

The pacifiers of the invention preferably include a partition to define the mouth posterior to the base and to define a rear portion of the hollow lumen.

The shield of the pacifiers of the invention may have a posterior surface, wherein the posterior surface of the shield has a shield opening and a partition defining the mouth posterior to the base is inserted into the shield opening and attached to the shield, wherein the partition defines a rear portion of the hollow lumen, wherein the shield has at least two (preferably four) air holes, wherein the partition has at least two (preferably four) air holes, wherein the air holes of the shield longitudinally align with the air holes of the partition.

The pacifier may also comprising a shield and a nipple, wherein the nipple extends longitudinally from the shield, wherein the nipple and shield define a hollow lumen comprising a nipple portion of the lumen and a shield portion of the lumen, wherein the nipple portion of the lumen defines internal surface of the nipple, and wherein the pacifier defines a mouth posterior to the base, the mouth having a mouth diameter smaller than a largest transverse dimension of a bottom surface of the nipple, further comprising a hollow elongated handle having continuous sidewalls defining a handle portion of the hollow lumen, wherein the continuous sidewalls have a continuous perimeter, wherein the hollow elongated handle extend posteriorly from the shield, wherein the hollow elongated handle is integral with the shield, wherein the handle portion of the hollow lumen is aligned with the mouth, wherein the hollow elongated handle has an open posterior end, wherein the shield, nipple, and base are integral as a single part body, wherein the mouth is defined by a partition defining the smaller mouth therein, said partition being connected at a location selected from the group consisting of:

said partition being connected to the shield to be incorporated into the shield;

said partition being connected to a hollow elongated (typically circular) handle extending from the shield posterior and incorporated into the handle; and said partition being partially connected to the shield and partially connected to the hollow elongated handle extending from the shield posterior to be incorporated into the shield and the handle.

A pacifier comprising a shield and a nipple and optionally a base, wherein the nipple extends longitudinally from the shield or if the base is present the nipple extends longitudinally from the base, wherein if the base is present the base extends longitudinally from the shield, wherein the nipple and shield define a hollow lumen comprising a nipple portion of the lumen and a shield portion of the lumen, wherein the nipple portion of the lumen defines internal surface of the nipple, further comprising a hollow elongated handle having continuous sidewalls defining a handle portion of the hollow lumen, wherein the continuous sidewalls have a continuous perimeter, wherein the hollow elongated handle extend posteriorly from the shield, wherein the hollow elongated handle is integral with the shield, wherein the handle portion of the hollow lumen is aligned with the mouth, wherein the hollow elongated handle has an open posterior end, wherein the shield, nipple, and optional base are integral as a single part body.

BRIEF DESCRIPTION OF THE DRAWINGS

Other embodiments, features and advantages of the invention described herein will occur to those skilled in the art from the following description of a preferred embodiment and the accompanying drawings, in which.

DETAILED DESCRIPTION OF THE INVENTION

Figure 1:
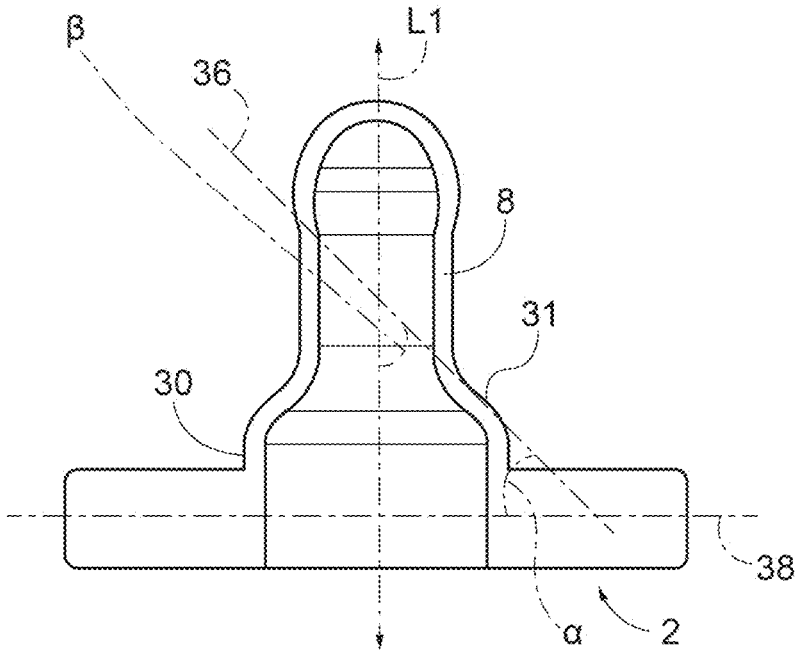
FIG. 1 (PRIOR ART)
FIG. 1 illustrates a prior art pacifier conventional uni-molded pacifier having a rear opening having a diameter as large as the interior lumen of the base of the pacifier with a base having a top wall with a slope of 45 degrees.

FIG. 1 (prior art) shows an existing uni-molded pacifier 2 having a shield 6, a shoulder (also known as a base) 30 extending from the shield 6, and a nipple stem 8 extending from the shoulder. FIG. 1 shows the outer surface of the pacifier 2 and has internal lines to represent its hollow interior. FIG. 1 shows an angle β (beta) formed by the intersection of a slope line 36 of a top wall 31 of the base 30 and the longitudinal axis L1 of the pacifier. The angle β (beta) is the angle on the right hand side of the longitudinal axis L1 below slope line 36 of the top wall 31 as viewed when facing the pacifier 2 with the nipple oriented upwardly. In FIG. 1 the angle β (beta) is about 45 degrees. Conventional pacifier 2 has an angle β (beta) formed by the intersection of a slope line 36 of the top wall 31 of the shoulder (base) 30 and the longitudinal axis L1 is 45 degrees or less. Slope line 36 tracks the slope of the surface of the top wall 31. Providing the top wall 31 of the base 30 with such a slope provides support to the stem 8, which in turn increases the required force that needs to be applied to the stem 8 to compress the walls together during the act of sucking as compared to a shoulder angle β (beta) greater than 45 degrees of the present invention as will be explained below. In particular the prior art pacifier of FIG. 1 has an angle α (alpha) of 45 degrees and angle β (beta) of 45 degrees. Angle α (alpha) is the angle formed where the slope 36 of the top wall 31 of the base 30 intersects the transverse axis 38 of the shield 6.

Figure 2:
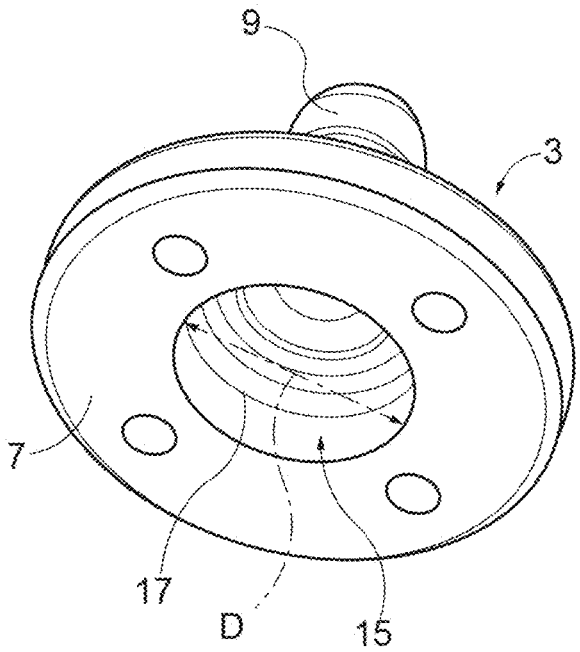
FIG. 2 (PRIOR ART)
FIG. 2 illustrates an angled bottom view of the prior art conventional uni-molded pacifier of FIG. 1 having a rear opening having a diameter as large as the interior lumen of the base of the pacifier.

FIG. 2 shows in conventional pacifiers, such as that of FIG. 1, the diameter of its posterior mouth is the same or very nearly identical to the diameter of the lumen of its shoulder (or base) 30. FIG. 1 shows a design of a conventional uni-mold pacifier 3 having a shield 7 and a base 17. It is hollow such that its nipple 9, base 17 and shield 7 together define a lumen. Here the opening or mouth 15 of the shield 7 has a diameter "D" as large, or nearly as large, as the diameter of the most proximal portion of the lumen within the base 17. In other words the shield 7 has the diameter "D" as large, or nearly as large, as the internal diameter of the base 17. The pacifier of FIGS. 1 and 2 would have a handle such as handle 104 of FIG. 3 but the handle is not shown to make these figures easier to read.

A first embodiment of the invention is shown in FIGS. 3-7A. A pacifier 102 has a handle 104 for holding the pacifier, a shield 106 and a nipple comprised of a stem 108 mated to a base 110 that is mated to the shield 106. The stem 108, base 110 and shield 106 together define a hollow interior (lumen). The shield 6 contains at least two air holes 112, preferably four air holes 112 as shown in FIG. 2. The invention has an opening or mouth 114 that has an internal diameter "D1" less than the diameter "D2" of the lumen 116 of the most proximal portion of the base 110 shown in FIG. 5. The mouth 114 has a posterior open end and an anterior open end.

Figure 3:
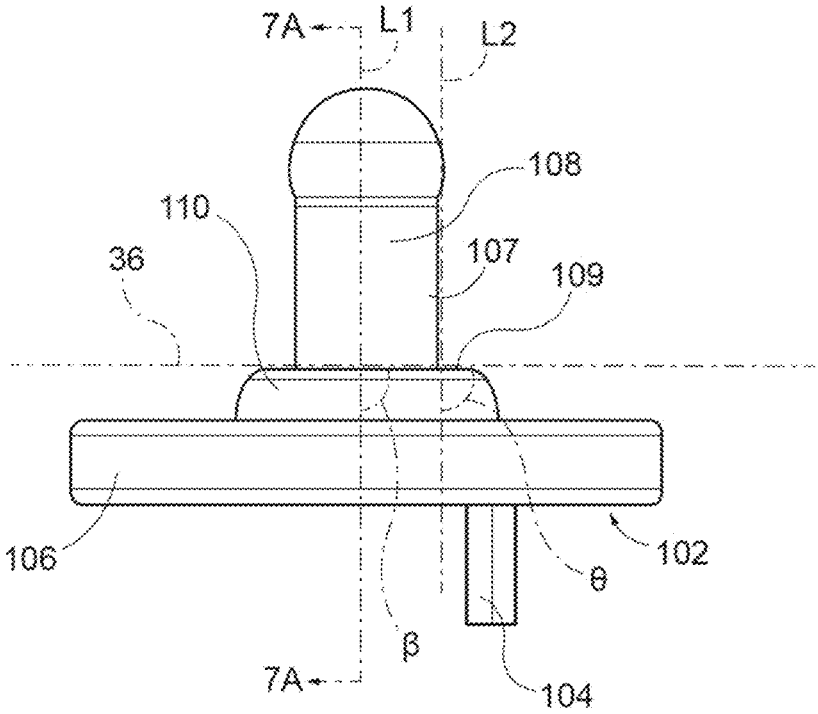
FIG. 3 illustrates a pacifier according to a first embodiment of the invention.
Figure 4:
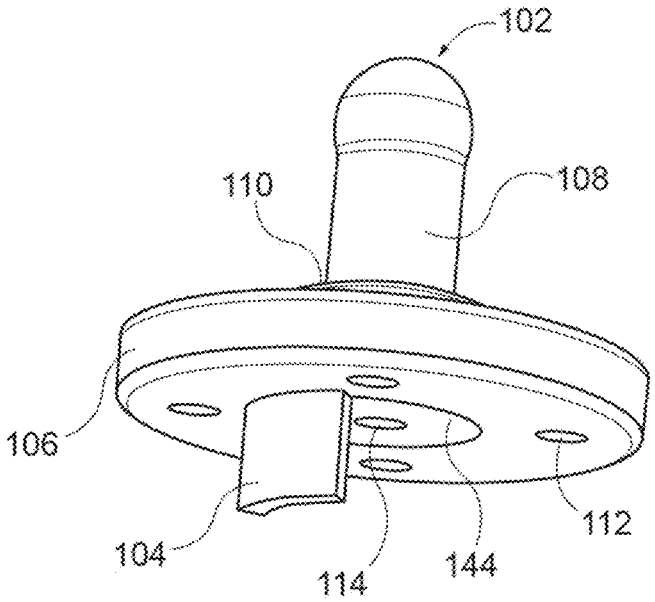
FIG. 4 illustrates an angled bottom view of the pacifier shown in FIG. 3.
Figure 5:
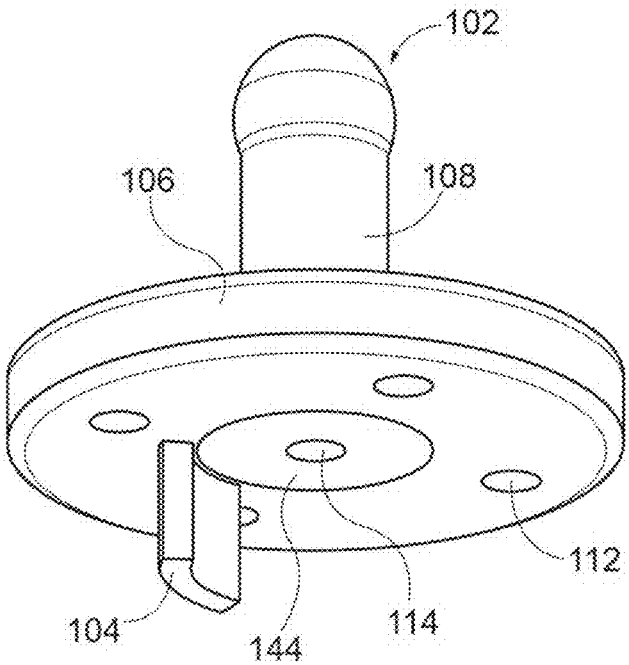
FIG. 5 illustrates a greater angled bottom view of the pacifier shown in FIG. 3.

FIG. 3 shows an angle β (beta) formed by the intersection of a slope line 36 of a top wall 109 of the base 110 and the longitudinal axis L1 of the pacifier. The angle β (beta) is the angle on the right hand side of the longitudinal axis L1 below slope line 36 of the top wall 109 as viewed when facing the pacifier 102 with the nipple oriented upwardly. In FIG. 3 the angle β (beta) is about 90 degrees. However, the angle β (beta) may be in the range of 55 to 120 degrees, preferably 75 to 110 degrees, more preferably 80 to 100 degrees, further more preferably 85 to 100 degrees, further more preferably greater than 90 degrees to at most 100 degrees, with the most desired angle β being about 90 degrees±2 degrees. In contrast, conventional pacifiers typically have an angle β of about 45 degrees (see FIG. 13).

The stem 108 sidewalls are parallel or approximately parallel to the longitudinal axis L1. Thus, the stem 108 and the top wall 109 of the base (110) meet at an angle theta (θ) approximately equal to angle β (in particular within ±5% of angle β (beta), preferably±2% of angle β (beta) most preferably equal to angle β (beta)). Angle theta (θ) is formed by intersection of slope line 36 which tracks the slope of the surface of the top wall 109 and a longitudinal line L2 which tracks the side walls 107 of the nipple stem 108 and parallels or approximately parallels L1.

FIGS. 4-7A show the shield 106 has a disc shaped partitioning insert which is an annular disc 144. Air holes 112 go all the way through the shield such that if the shield 106 is intruded into a child's mouth, the child can move air past the shield 106. The annular disc 144 (also termed a washer) is an annular washer shaped disc with the pacifier rear opening 114 extending entirely there through. Although not shown the disc 144 could have more than one pacifier rear opening 114.

Figure 6A:
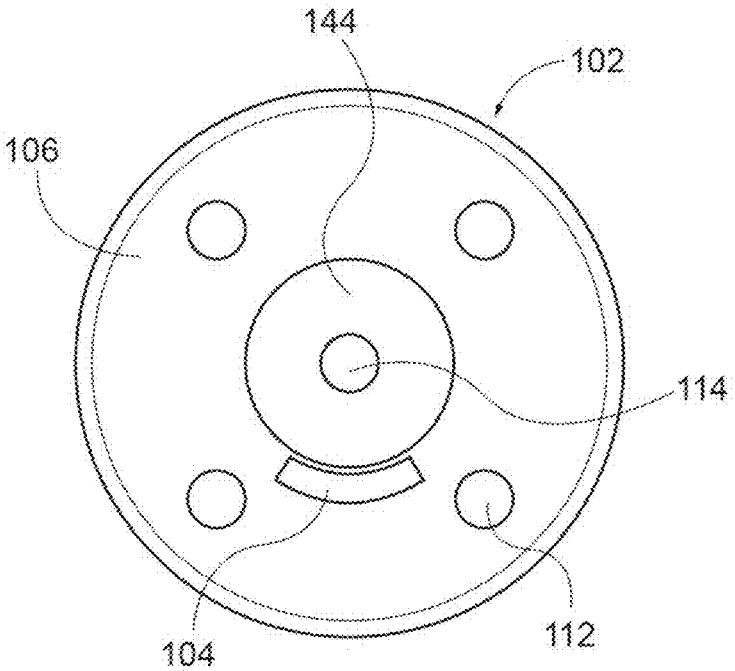
FIG. 6A illustrates a bottom view of the pacifier shown in FIG. 3.
Figure 6B:
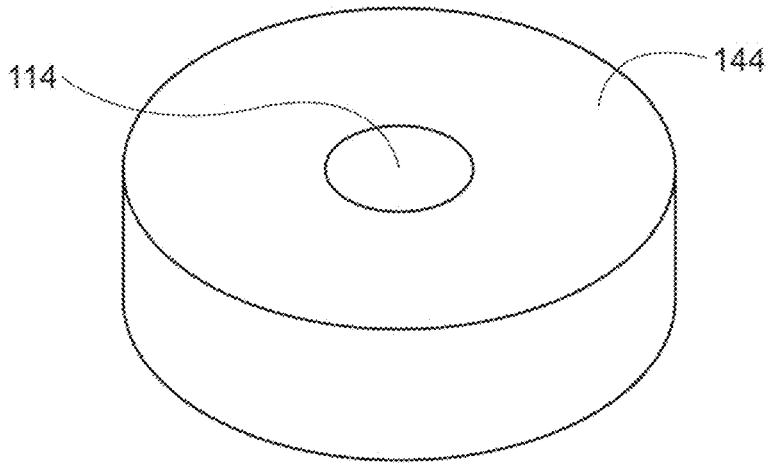
FIG. 6B shows a disc shaped partitioning insert as an annular disc that can be used at the posterior of the pacifier shield.

FIG. 6B shows an enlarged view of the annual shaped partition (disc) 144 having pacifier rear opening 114.

Figure 7A:
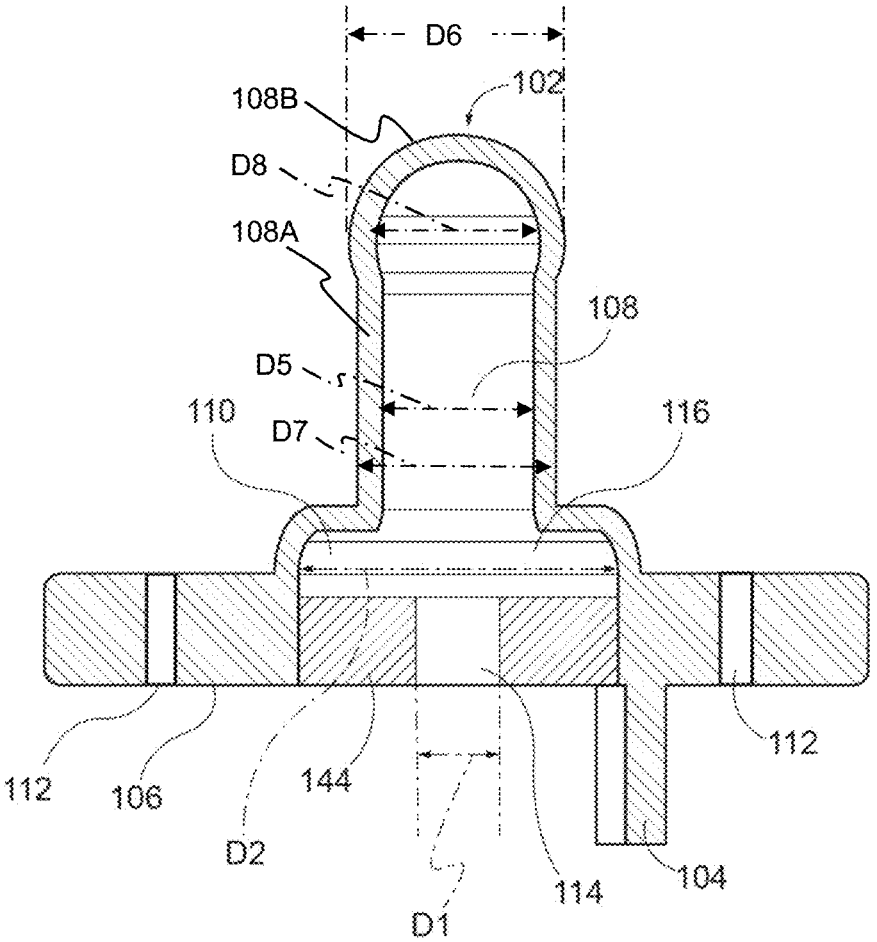
FIG. 7A illustrates a cross-section along view 7A-7A (representing a view along a middle plane) of the pacifier shown in FIG. 3 having a base with 90 degree angle shoulders where the shoulders meet the nipple stem.
Figure 7B:
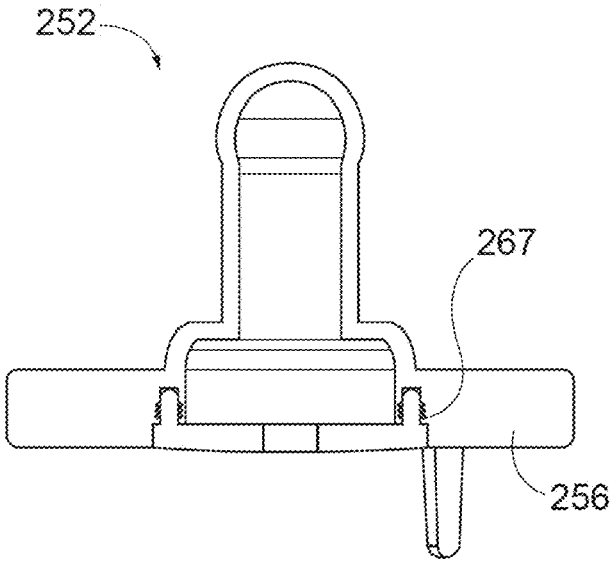
FIGS. 7B-7E show a pacifier which is a modification of the pacifier of FIG. 7A having a shield molded to have a step and a partition is inserted to sit on the step. The partition has prongs to insert into openings of the step, wherein the partition prongs have undercut back angled ribs to lock into the openings of the step.
Figure 7C:
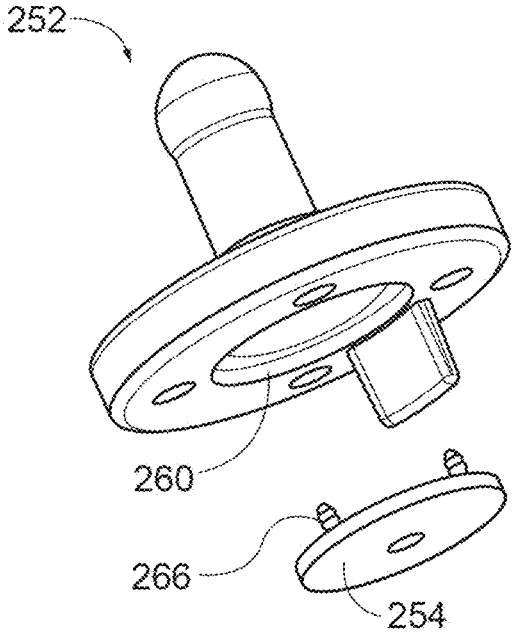
Figure 7D:
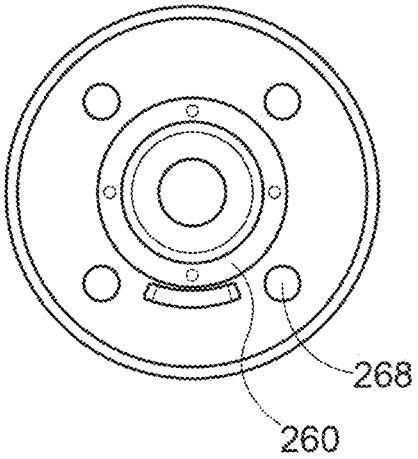
Figure 7E:
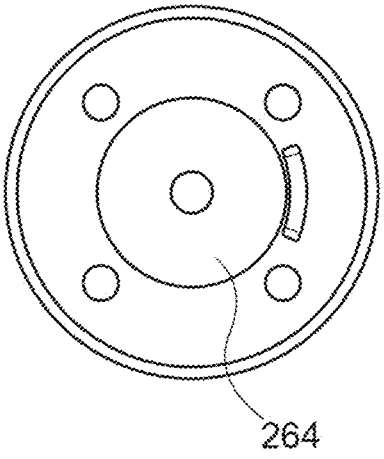

FIG. 7A shows a cross section of pacifier 102 along view 7A-7A of FIG. 3 representing a cross-section of a mid-plane of the pacifier when viewed from the front. The stem 108, base 110 and shield 106 together define a hollow interior (lumen). FIG. 7A shows the diameter D2 of the lumen 116 of the base 110 is much larger than the diameter D1 of the posterior mouth 114. The pacifier 102 is molded in a first stage to have a large posterior mouth and subsequently in a second stage is molded to form the annular disc 144 by a second shot of polymer or other molding material. Thus, the core (not shown) used during the first stage of molding of the pacifier 2 is removed from the pacifier's mouth because, as happens with molding of a "conventional" mouth 15 (FIG. 1), there is no negative draft. However, the present pacifier 102 has more center mass, and a much smaller mouth 114, relative to the lumen 116 of the base 106. In the alternative the pacifier 102 is molded in a first stage to have a large posterior mouth and subsequently in a second stage the annular disc 144 is inserted into the large posterior mouth and attached to the shield 106. FIG. 7A shows the stem (nipple) 108 has a posterior neck 108A and a distal end head portion 108B. FIG. 7A shows the distal end head portion 108B as a bulbous end such that at least a portion of the distal end head portion 108B has a transverse outer diameter "D6" larger than the transverse outer diameter "D7" of the neck 108A. As seen in FIG. 7A the distal head portion 108B also has a maximum inner diameter "D8". However, any conventional end shape is suitable, For instance, the distal head end portion could be a simple hemisphere with the base of the hemisphere having the same outer diameter as the neck. The inner diameter "D5" of the neck 108A is larger than the diameter D1 of the open posterior mouth 114. As seen in FIG. 7A the pacifier mouth 114 is open and exposed. As seen in FIG. 7A the pacifier mouth 114 is an opening at the rear of the pacifier 102. As used in the present specification, and seen in all the figures discussed in the present specification showing a pacifier mouth, the pacifier mouth is an opening in the pacifier.

FIGS. 7B-7E show a pacifier 252 which is a modification of the pacifier of FIG. 7A having a shield 256 is molded to have a step 260 and a partition 264 is inserted to sit on the step 260. The partition 264 has prongs 266 to insert into openings 268 of the step 260. The partition prongs 266 have undercut back angled ribs to lock into the openings 268

Figure 8:
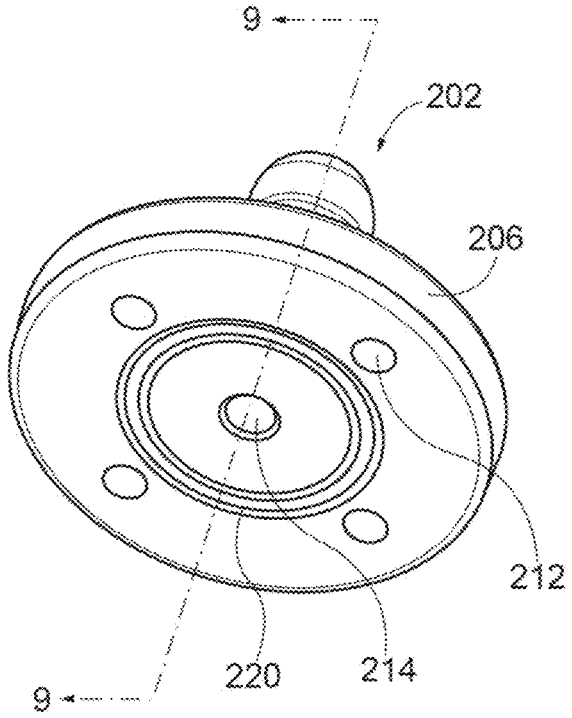
FIG. 8 illustrates a bottom perspective view of a second embodiment of a shield of the invention for use with the pacifier of FIG. 3.
Figure 9:
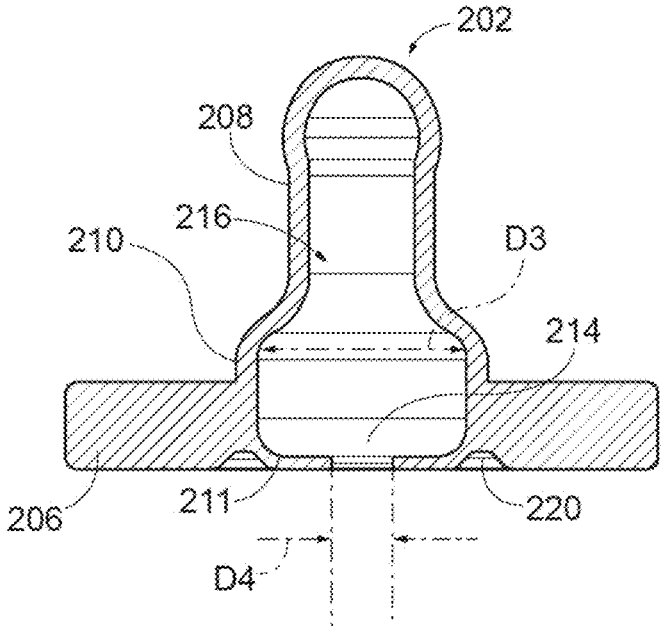
FIG. 9 illustrates a cross-section of the pacifier of FIG. 8 along view 9-9 employing the novel shield of FIG. 8 but a base with a conventional 45 degree angle β (beta).

FIGS. 8 and 9 are the different views of the same pacifier 202. FIG. 9 is a cross-section along view 9-9 of FIG. 8. FIGS. 8 and 9 show a pacifier 202 of the present invention having a shield 206, a base, 210, and a stem 208. It is an improvement over the prior art pacifier of FIG. 1. It has the shoulder of the base to the stem at 45 degrees like conventional pacifier of FIG. 1 but it has a small posterior opening 214 according to the present invention. In particular, FIG. 8 shows the novel shield having a trough 220. FIG. 9 shows the difference in the surface area and diameter "D3" of the lumen 216 and the diameter "D4" of the posterior mouth 214. FIG. 9 shows the stem 208, base 210 and shield 206 together define a hollow interior (lumen 216). FIG. 9 shows the diameter D3 of the lumen 216 of the base 210 is much larger than the diameter D4 of the mouth 214. The pacifier 202 has a rear wall 211 below the lumen 216. The pacifier 20 of FIGS. 8 and 9 would have a handle such as handle 104 of FIG. 3 but the handle is not shown to make these figures easier to read. Typical handles have a length of 10 to 20 mm. The shield of FIG. 9 may be also used to substitute for the base of pacifiers of the invention in general. For example, the shield of FIG. 9 may replace the shield of the pacifier of FIG. 3. Thus, the pacifier of FIG. 9 may be modified to replace the base with a conventional 45 degree angle β (beta) with a novel base with a 55 to 120, preferably 75 to 110 degrees (or greater than 90 and at most 100), e.g., 90 degree angle β (beta).

In general, pacifiers of the present invention have a base having a largest transverse dimension larger than the largest transverse dimension of the nipple. Typically, the largest transverse outer dimension of the base of the present pacifier is larger, typically 20 to 120% larger, than the largest transverse outer dimension of the nipple. FIG. 9 illustrates this by outer diameter D6 of the base 210 being significantly larger than outer diameter D5 of the nipple stem 208.

The shield 206 is molded as a single piece to define the small posterior opening 214. Thus, the shield of the pacifier of FIG. 9 is molded in one shot to have the small rear opening 214. The trough 220 circumferentially encloses the mouth 14. FIG. 9 shows a cross-section of the pacifier 202 of FIG. 8 along view 9-9. The trough 220 allows for flex of the floor of the area around the rear (posterior) mouth 214 to give way enough to allow the removal of the core after molding the pacifier 202.

However, in the alternative the pacifier 202 is molded in a first stage to have a large posterior mouth and subsequently in a second stage is molded to form a disc shaped partitioning insert such as above-discussed disc 144 by a second shot of polymer or other molding material. Thus, the core (not shown) used during the first stage of molding of the pacifier 2 is removed from the pacifier's mouth because, as happens with molding of a "conventional" mouth 15 (FIG. 1), there is no negative draft. However, the present pacifier 202 has more center mass, and a much smaller mouth 214, relative to the lumen 216 of the base 206. In the alternative the pacifier 202 is molded in a first stage to have a large posterior mouth and subsequently in a second stage an disc shaped partitioning insert such as the above-discussed annular disc 144 is inserted into the large posterior mouth and attached to the shield 206.

Figure 10:
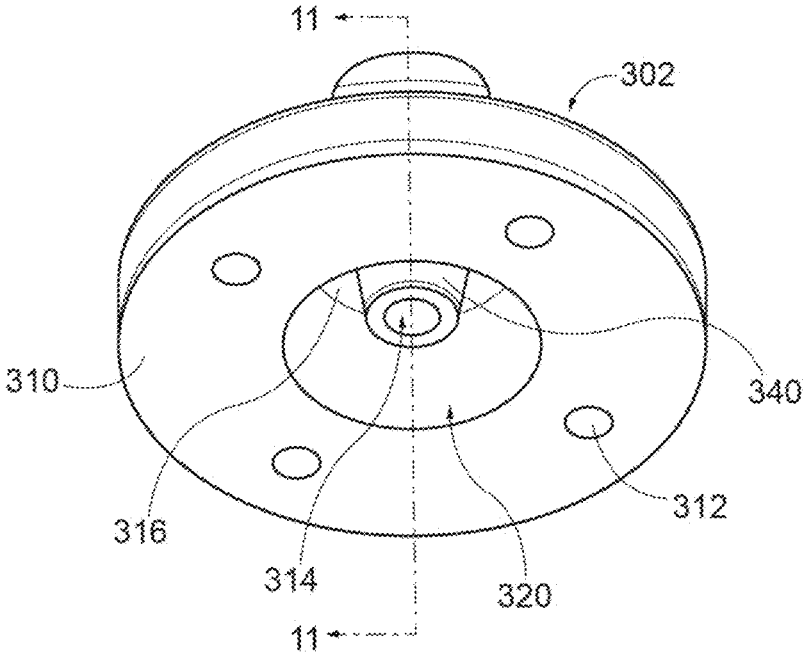
FIG. 10 illustrates an angled bottom view of a third embodiment of a shield of the invention for use with the pacifier of FIG. 3.
Figure 11:
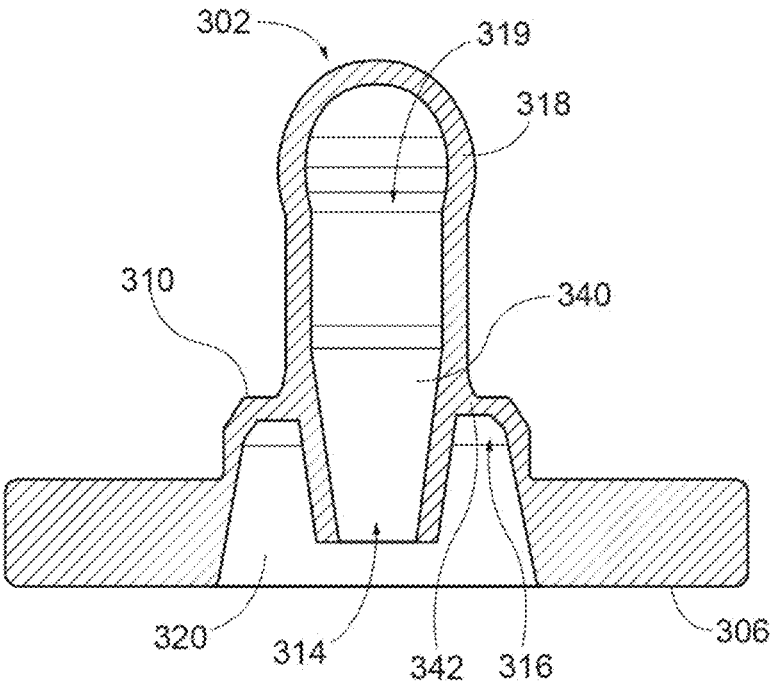
FIG. 11 illustrates a cross-section of the pacifier shown in FIG. 10 along view 11-11.

FIGS. 10-11 show a pacifier 302 of the present invention. It is pacifier 102 of FIG. 3 modified to have another embodiment of a shield 306. The opening, or mouth 314, opens into a frustoconical shaped funnel 340, which communicates with the lumen 319 of the hollow stem 318, but not into the lumen 316 of the base 310. The funnel 340 has thin enough walls to allow the removal of the core from the manufacturing (molding) process. The trough 320 communicates to the lumen of the base 316. The outer walls of the funnel 340 make contact and mate to the inner walls 342 of the base 310. The shield 306 contains at least two air holes 312, preferably four air holes 312 as shown in FIG. 10.

FIG. 11 shows a cross-section of the pacifier 302 of FIG. 10 along view 11-11.

Figure 12:
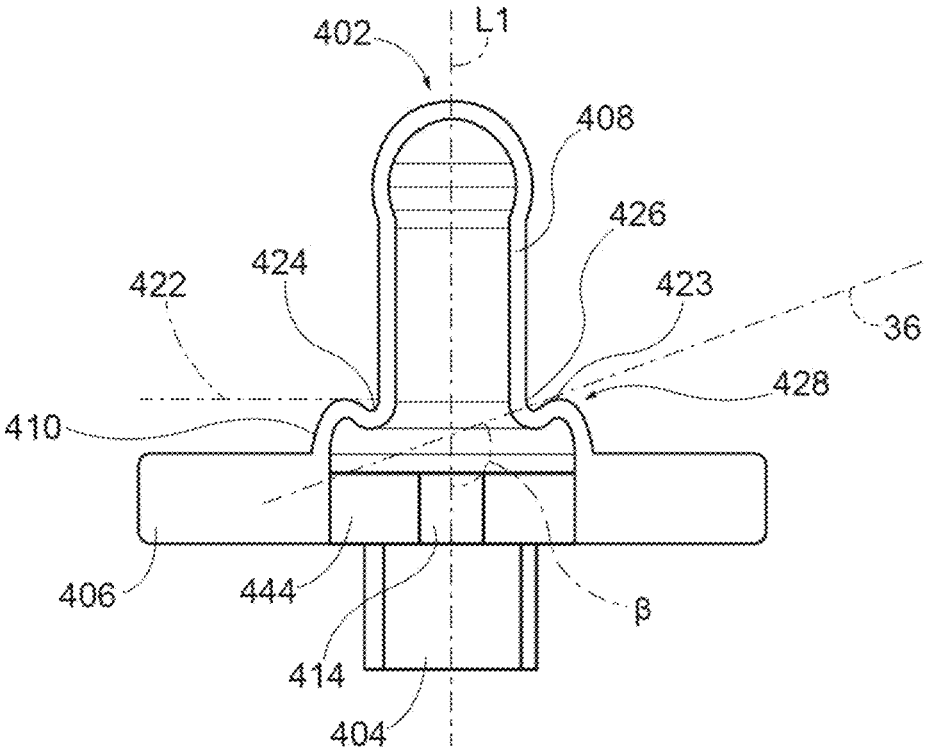
FIG. 12 illustrates a cross-section of the pacifier of the invention having a stem, a second embodiment of a base, and a shield, wherein the stem inverts into the base and mates to the base at a negative line angle, relative to the outer surface of the superior height of the base in relation to the most proximal end of the stem, it also shows the negative degree shoulder (inverted area) overlaid by a dashed line representing a hypothetical base angle of 90 degrees to show a distinction between a 90 degree angled configured pacifier and a negative angled degree pacifier.

FIG. 12 shows a pacifier 402 of the present invention. It is pacifier 102 of FIG. 3 modified to have a base 410 having an inverted slope line 36. It has a shield 406 provided with a disc shaped partitioning insert (also known as an annular partition, disc or washer) 444, the base 410 extending from the shield 406 and having a posterior opening 414 (also known as a shield mouth). A nipple stem 408 extends from the base 410.

Because of the inverted slope, the angle β (beta) where the slope line 36 of the top wall 423 meets longitudinal axis L1 is in the range of at least greater than 90 to at most 120 degrees, preferably at least greater than 90 to at most 110 degrees, more preferably at least greater than 90 to at most 100 degrees. The angle β (beta) is the angle on the right hand side of the longitudinal axis L1 below slope line 36 of the top wall of the base 410 as viewed when facing the pacifier 102 with the nipple oriented upwardly (as, for example, shown in FIG. 12).

FIG. 12 illustrates a cross-section of a second embodiment of the pacifier 402 of the invention having the stem 408, the base 410, and a shield 406. FIG. 12 shows the pacifier 402 has an angle β (beta) greater than 90 degrees so the stem 408 mates to the base 410 at a negative line angle at location 424. The stem 408 inverts into the base 410 and mates to the base 410 at a negative line angle, relative to the outer surface 428 of the superior height of the base 410 in relation to the most proximal end of the stem 408. Thus, the stem 408 would invert into base 410 such that the most proximal end of the stem 426 would be below, or inferior, to the outer surface 428 of the base 410.

FIG. 12 includes an overlay of a line 422 which is 90 degrees to the longitudinal axis L1 to emphasize the difference between a 90 degree angle and the inverted angle β.

The differing angulations of the top wall of the base are shown by comparing FIG. 1 (prior art) and FIG. 3 (invention). TABLE 1 shows the increased force or tension faction resulting from different angles of the top wall of the base.

FIG. 1 (prior art) shows angle β (beta) formed by the intersection of the slope line 36 of the top wall 9 of the shoulder (base) 10 and the longitudinal axis L1 of the pacifier as 45 degrees. FIG. 1 also shows angle α (alpha) formed by the intersection of the slope line 36 and the transverse axis 38 of the shield 6 as 45 degrees. The transverse axis 38 is the axis along the transverse centerline of the pacifier shield 6.

FIG. 3 shows angle β (beta) formed by the intersection of the slope line 36 of the top wall 109 of the shoulder (base) 110 and the longitudinal axis L1 of the pacifier increased to 90 degrees. In the pacifier of FIG. 3 angle α (alpha) is formed by the intersection of the slope line 36 and the transverse axis of the shield 106 but it decreased to 0 degrees and thus is not labeled. This results in the lowering of tension or applied force to the shoulder. For example, in TABLE 1, if one had a line angle at α (alpha) of 45 degrees, and it was under a load, and a line angle at β (beta) of 45 degrees, under a load, and the line angle at α (alpha) decreased to 0 degrees and the line angle at β (beta) increased to 90 degrees, then the force or tension applied to the shoulder and on to the stem would be a decrease of 41% of applied force.

TABLE 1

Calculated force or tension factors for various angle combinations

| Line Angle with Load (degrees) | | |
|---|---|---|
| Alpha | Beta | Increased Force or Tension Factor |
| 0 | 90 | 1.00 |
| 5 | 85 | 1.00 |
| 10 | 80 | 1.02 |
| 15 | 75 | 1.04 |
| 20 | 70 | 1.07 |
| 25 | 65 | 1.10 |
| 30 | 60 | 1.16 |
| 35 | 55 | 1.22 |
| 40 | 50 | 1.31 |
| 45 | 45 | 1.41 |
| 50 | 40 | 1.56 |
| 55 | 35 | 1.74 |
| 60 | 30 | 2.00 |
| 65 | 25 | 2.37 |
| 70 | 20 | 2.92 |

TABLE 1-continued

Calculated force or tension factors for various angle combinations

| Line Angle with Load (degrees) | | |
|---|---|---|
| Alpha | Beta | Increased Force or Tension Factor |
| 75 | 15 | 3.86 |
| 80 | 10 | 5.76 |
| 85 | 5 | 11.5 |

Therefore, a 90 degree angle β (beta) formed by the longitudinal axis L1 and slope line 36, which is equal to or approximately equal to the angle θ (theta) formed by the intersection of the sidewalls of the stem 126 (represented by line L2) and the slope 36 of the top wall 109 of the shoulder (base) 110, would equate to 41% less applied force to that area as compared to an angle β (beta) of 45 degrees of a conventional pacifier.

Figure 13:
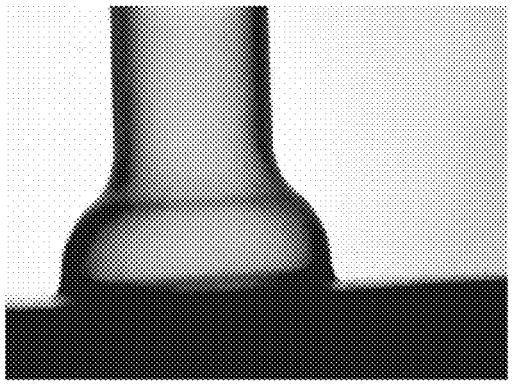
FIG. 13 (PRIOR ART)
FIG. 13 shows a photograph of a portion of a prior art pacifier.

FIG. 13 shows a photo of a prior art product corresponding to that of FIG. 1 having an angle α (alpha) of 45 degrees and an angle β (beta) of 45 degrees.

Figure 14:
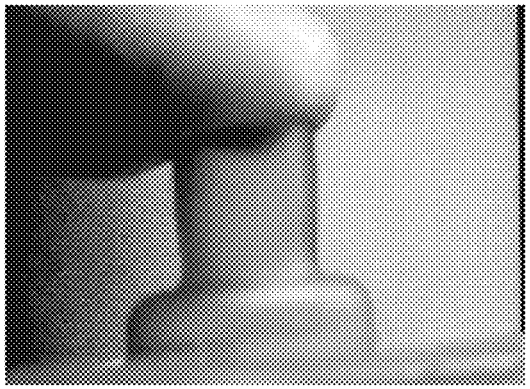
FIG. 14 shows a photograph of a portion of a pacifier of the present invention.

FIG. 14 shows a photo of a product of the invention corresponding to that of FIG. 3 having an angle α (alpha) of 0 degrees and an angle β (beta) of 90 degrees.

Figure 15:
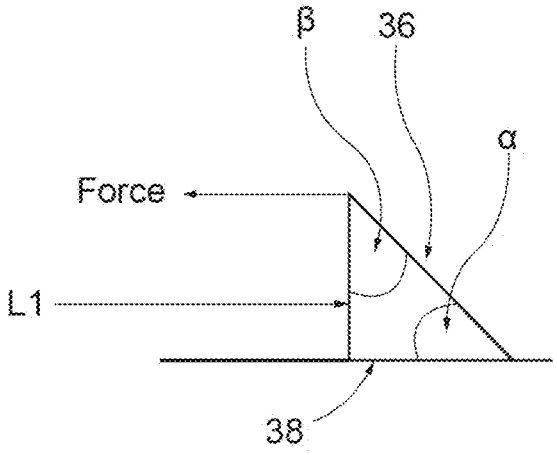
FIG. 15 illustrates a vector diagram describing forces acting on the stem of a pacifier.

FIG. 15 depicts the forces on a pacifier shoulder (base) where the angle α (alpha) is in relation to the vertical axis 36 of the base and the angle β (beta) is in relation to the horizontal axis of the stem 38. FIG. 15 and TABLE 1 show applied force decreasing as the shoulder angle is increased.

FIG. 15 depicts the forces on a pacifier shoulder (base) where the angle α (alpha) is in relation to the transverse axis 38 of the base and the angle β (beta) is in relation to the longitudinal axis L1 of the stem. FIG. 15 and TABLE 1 show applied force decreasing as the shoulder angle β (beta) increases.

Figure 16:
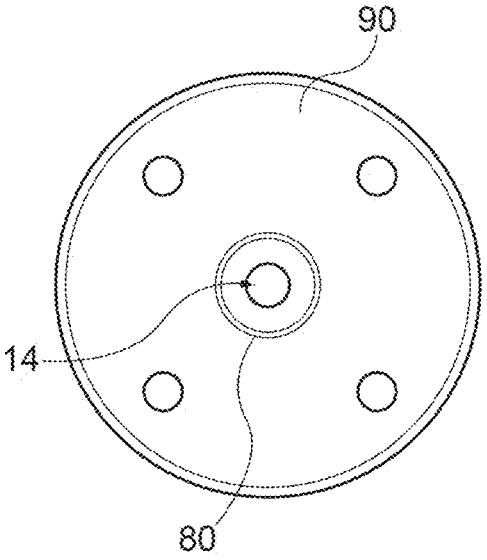
FIG. 16 illustrates a ring of different material, for example higher durometer material, not in contact with mouth of the shield, regardless of the mouth's diameter in relation to the dimensions of the base's lumen.

FIG. 16 illustrates a shield 90 provided with a ring 80 of different material, for example higher durometer material, not in contact with mouth, no matter the mouth's diameter in relation to the dimensions of the base's lumen. The ring 80 can be made of material that will provide illumination via phosphorescent or photoluminescent plastics.

Figure 17:
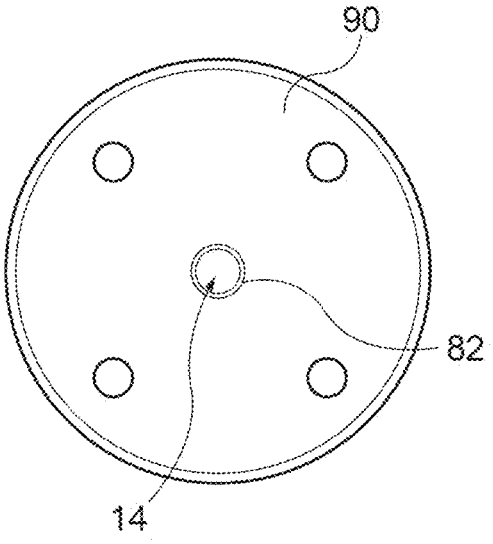
FIG. 17 illustrates a ring of different material, for example higher durometer material, in contact with the mouth of the shield regardless of the mouth's diameter in relation to the dimensions of the base's lumen.

FIG. 17 illustrates pacifier shield 90 provided with a ring 82 of different material, for example higher durometer material, in contact with mouth, no matter the mouth's diameter in relation to the dimensions of the base's lumen. The ring 80 can be made of the same luminescent material as ring 80.

The center piece ring 80, 82, being of a higher durometer material could be added to the periphery of the opening 14 and the opening being the same size as conventional versions to create a stiffer shield. A stiffer material added to the pacifier of a less stiff material that will increase the stiffness of the shield so that it will be less likely to "fold in" if the pacifier would be pushed into the mouth by accident. The ring could also be around the peripheral margin of the shield as well. Also the ring could be made to add a different color and glow in the dark feature away from the center of the mouth. Pacifiers with the center piece ring 80, 82 could be made by a two shot mold process with different material durometer.

Thus, one could manufacture a material of a higher or lesser durometer into the shield such that it does not have to be the same as the disc (44) with the mouth (14). It could be a circular shape at the periphery of the shield or further to the middle, but not containing the mouth. So, someone could add this feature to stiffen the shield or add more colors, etc.

Figure 18:
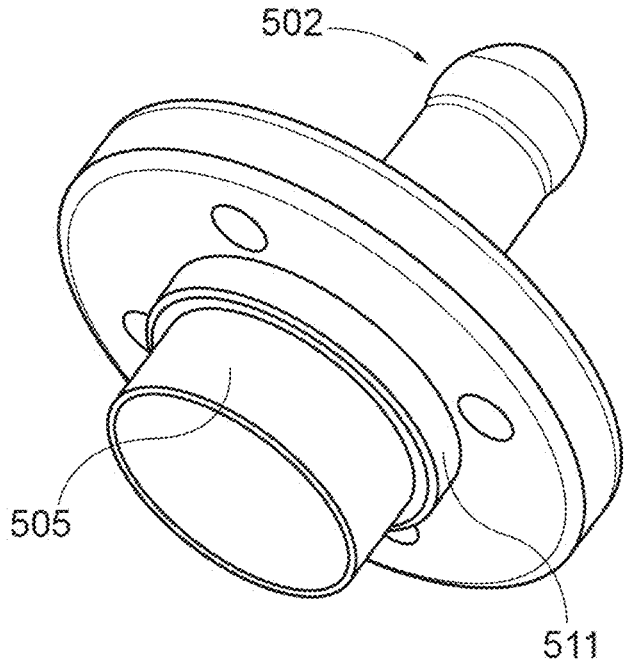
FIG. 18 shows a perspective view of a pacifier of the present invention with a snap fit assembly and handle.

FIG. 18 shows a perspective view of a pacifier 502 of the present invention with a snap fit assembly and handle 505.

Figure 19:
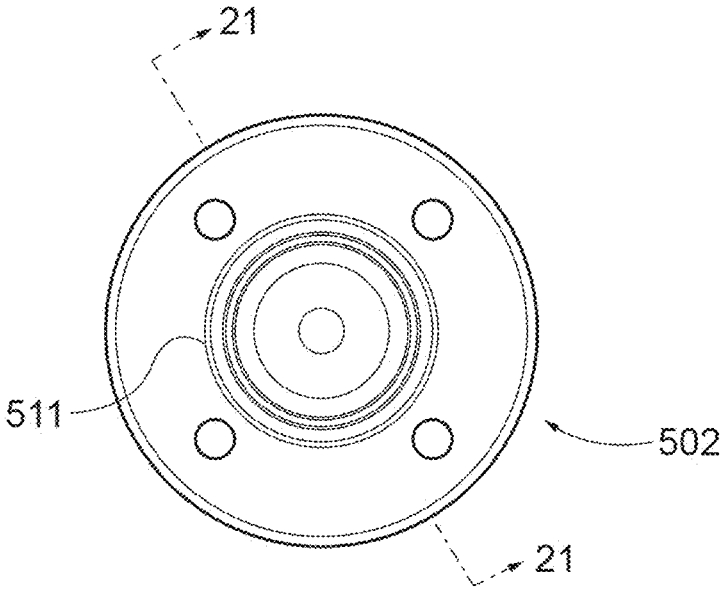
FIG. 19 shows a bottom view of the pacifier of FIG. 18 with the snap fit assembly and handle.

FIG. 19 shows a bottom view of the pacifier 502 of FIG. 18 with a snap fit assembly and handle.

Figure 20:
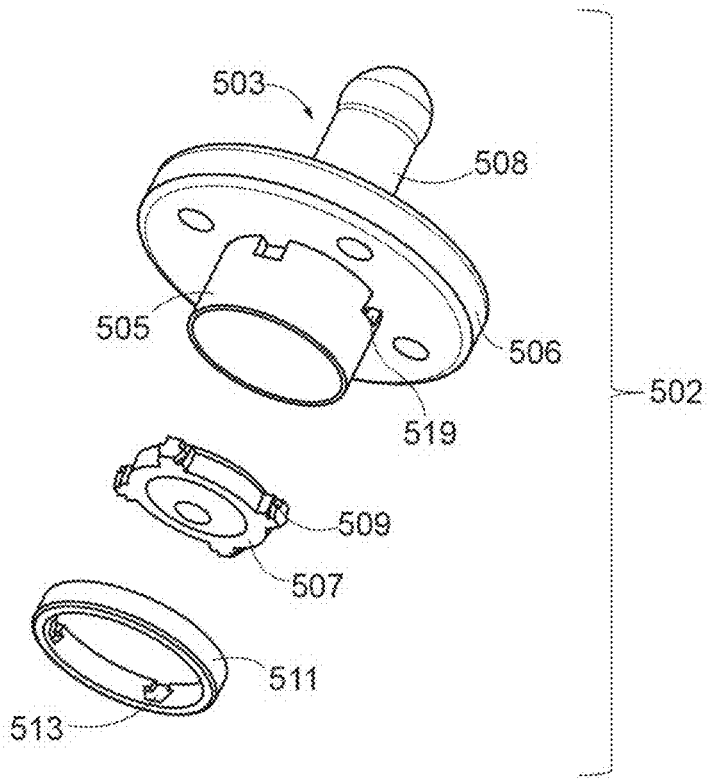
FIG. 20 shows an exploded view of the pacifier of FIG. 18 to show the main body of the pacifier comprising the stem, the shield, and the cylindrical handle, wherein the cylindrical handle extends from the posterior of the shield, a disc shaped partitioning insert and a snap locking ring.

FIG. 20 shows an exploded view of the pacifier 502 of FIG. 18. This shows the main body 503 of the pacifier 502 comprising the stem 508, the shield 506, and the cylindrical handle 505. The cylindrical handle 505 extends from the posterior of the shield 506, a disc shaped partitioning insert provided as a generally disc shaped member 507 (also known as a washer) and a snap locking ring 511. The generally disc shaped member 507 has a number of spaced extensions (arms) 509 for inserting through open notches 519 and locking into slots 513 of the snap locking ring 511. As seen in FIG. 20 the shield mouth is defined by the generally disc shaped member 507 locked in place up against the lumen of the shield 506.

Figure 21:
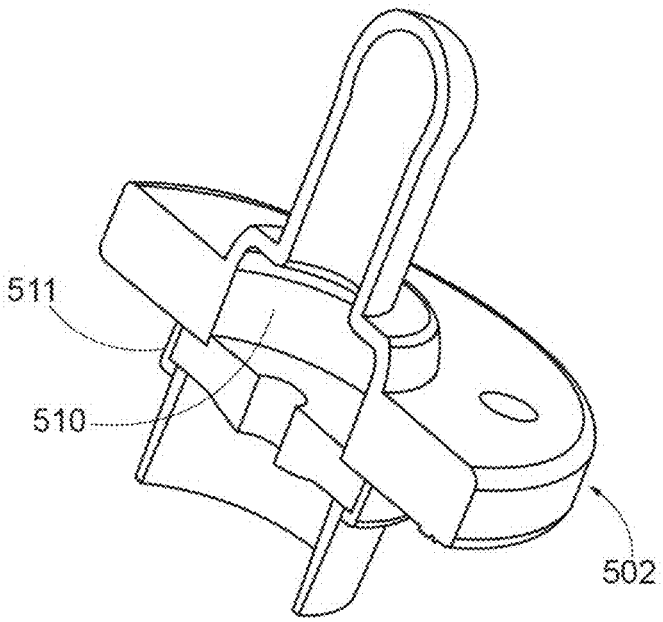
FIG. 21 shows a sectional view of the pacifier of FIG. 18 along view 21-21 of FIG. 19 and shows the interior of the hollow base of the pacifier.

FIG. 21 shows a sectional view of the pacifier 502 along view FIG. 21-FIG. 21 of FIG. 18 and shows the base 510.

Figure 22:
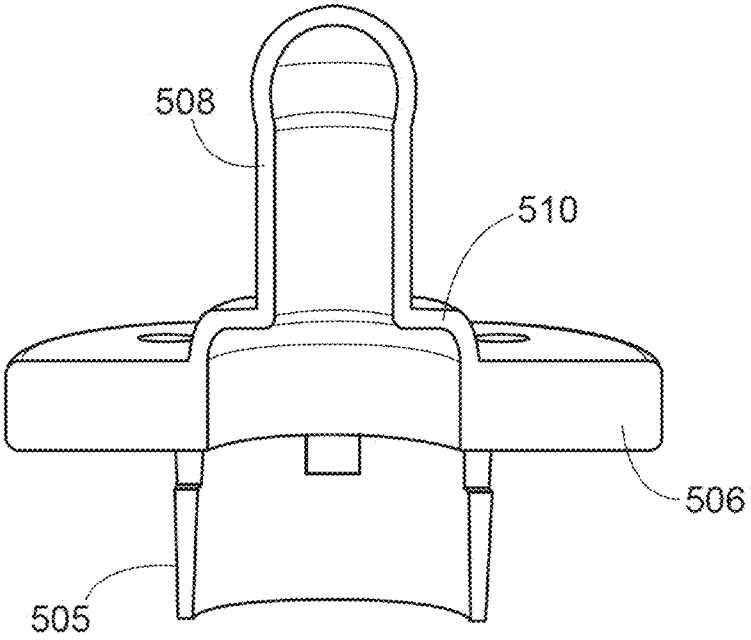
FIG. 22 shows a partial sectional view of the stem, base, shield, and handle of the pacifier of FIG. 18 wherein the disc shaped partitioning insert is omitted from this figure for clarity.

FIG. 22 shows a partial sectional view of the stem 508, base 510, shield 506, and handle 505 of the pacifier 502 of FIG. 18. The disc shaped partitioning insert is omitted from this figure for clarity.

Figure 23:
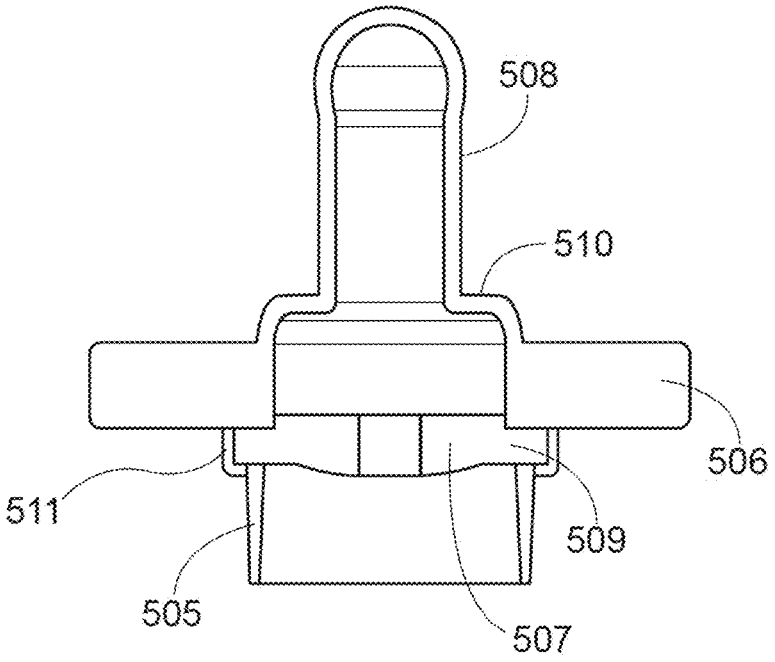
FIG. 23 shows a partial sectional view of the main body of the pacifier of FIG. 18 and locking ring.

FIG. 23 shows a partial sectional view of the main body of the pacifier 502 of the pacifier of FIG. 18 and ring 511.

Figure 24:
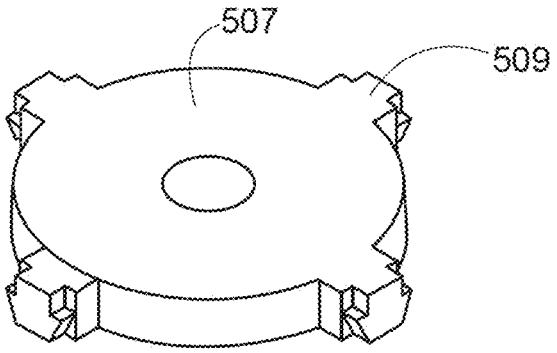
FIG. 24 shows the disc shaped partitioning insert of the pacifier of FIG. 18 as an annular partition (disc).

FIG. 24 shows the annular partition (disc) 507 of the pacifier of FIG. 18.

Figure 25:
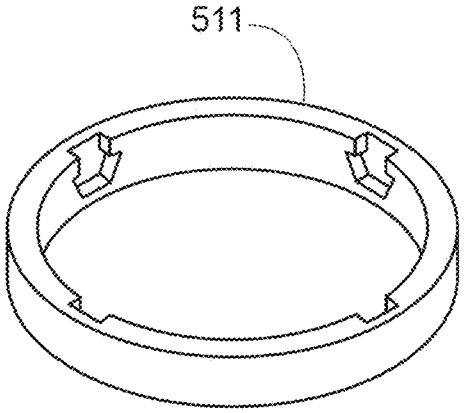
FIG. 25 shows the locking ring of the pacifier of FIG. 18.

FIG. 25 shows locking ring 511 of the pacifier of FIG. 18.

Figure 26:
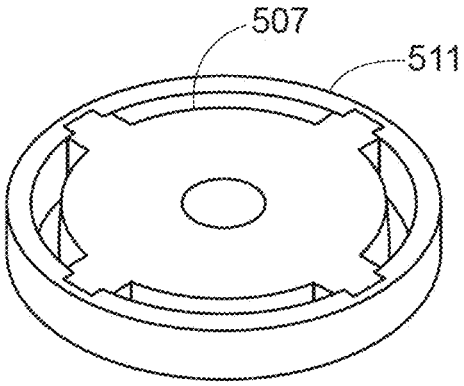
FIG. 26 shows the annular partition (disc) of the pacifier of FIG. 18 locked into the locking ring without showing the main body of the pacifier to be easier to view.

FIG. 26 shows the annular partition (disc) 507 of the pacifier of FIG. 18 locked into the locking ring 511 without showing the main body of the pacifier to be easier to view.

Figure 27:
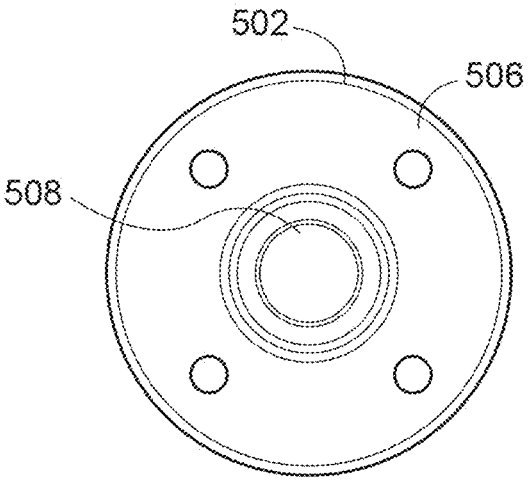
FIG. 27 shows a top view of the pacifier of FIG. 18.

FIG. 27 shows a top view of the pacifier 502 of FIG. 18.

Figure 28:
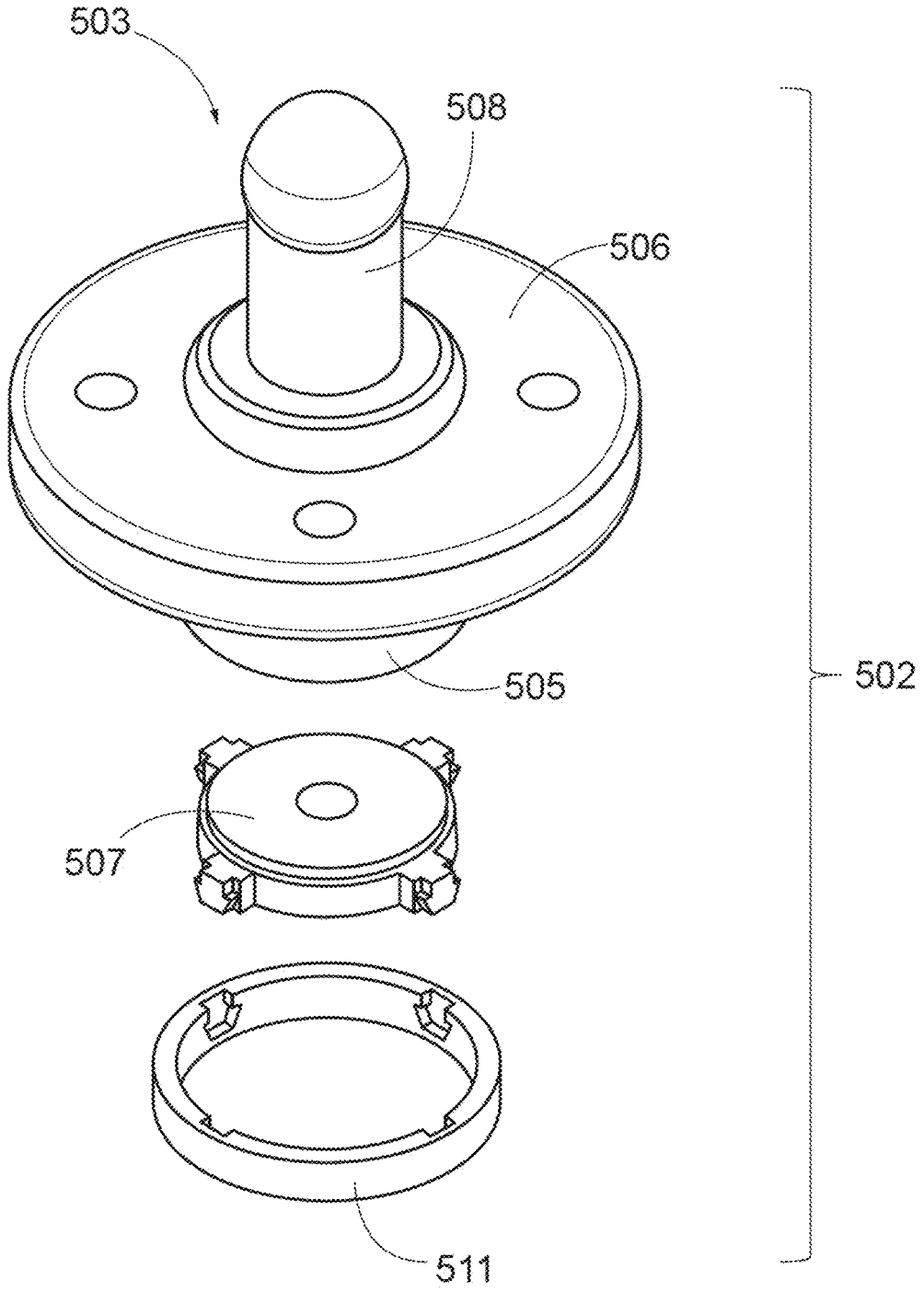
FIG. 28 shows another exploded view of the pacifier of FIG. 18.

FIG. 28 shows another exploded view of the pacifier 502 of FIG. 18.

Figure 29:
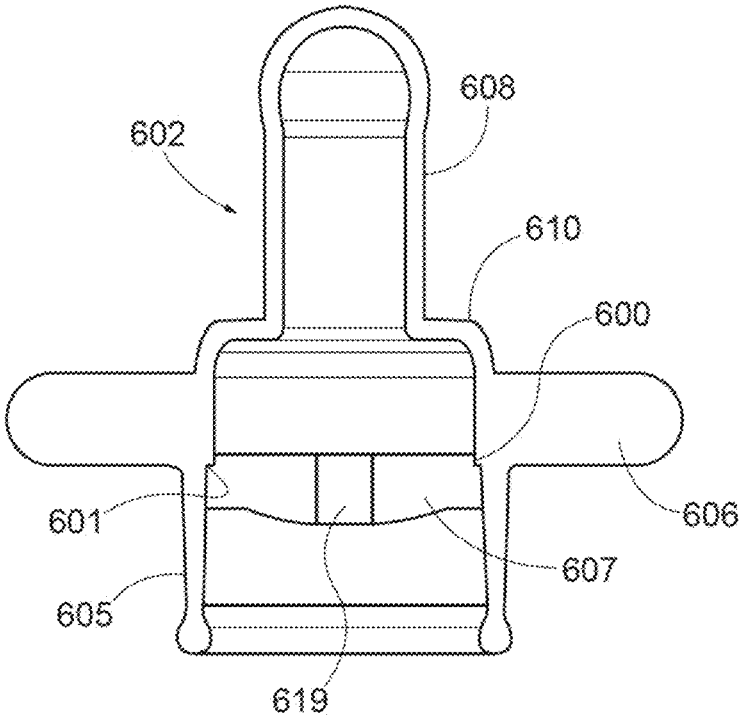
FIG. 29 shows a modification of the pacifier of FIG. 28 which omits the locking ring and disc extensions and it glues or welds an annular partition (disc) of the pacifier having a circular perimeter with an upper circular ledge within a handle of the pacifier to contact the shield and define a shield mouth.

FIG. 29 shows a pacifier 602 which is a modification of the pacifier of FIG. 28. Pacifier 602 has a nipple stem 608, a base 610, a shield 606, and a handle 605 generally molded as one piece. However, pacifier 602 omits the locking ring and disc extensions and glues or welds an annular partition (disc) 607 having a circular perimeter with an upper circular ledge 601 (also known as a shelf) within the handle 605 of the pacifier 602 to contact the lower surface of the shield 606. The annular partition (disc) 607 defines a shield mouth 619. The ledge 601 nesting against a complimentary ledge 600 of the shield 606. The ledge 601 and the complimentary ledge 600 are continuous.

Figure 31:
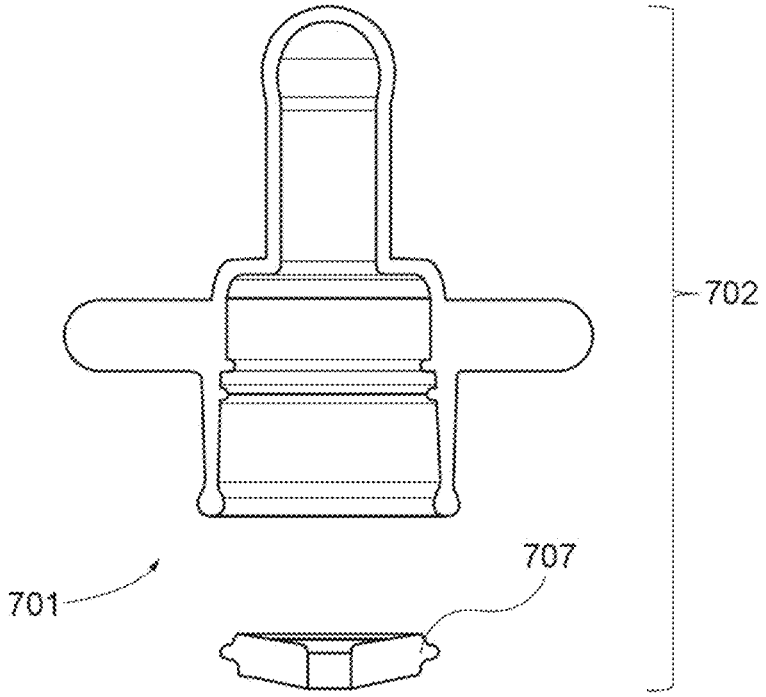
FIG. 31 shows an exploded view of a cross section of the pacifier of FIG. 30 along view 31-31 of FIG. 30.

Pacifier 602 of FIG. 29, and other pacifiers described below employ a generally disc shaped member. The generally disc shaped member 607 of this version has a substantially circular outer circumference rather than the locking extensions of the generally disc shaped member 507. These pacifiers also include a channel (for example as seen in FIG. 31) or ledge (for example as seen in FIG. 29) in the circular handle, or located in the shield, or located in both the handle and the shield into which the disc shaped member is nested and secured. The generally disc shaped member will be secured into the channel via "gluing" it with RTV silicone adhesive which is a liquid form of the same material as the pacifier, in this case medical grade silicone, and heating to form a bond. RTV silicone, or Room-Temperature-Vulcanization silicone, is a type of silicone rubber made from a two-component system of a base and a curative. In the pacifier 602 of FIG. 29, one wall of the channel is provided by a lower portion of the shield.

Instead of gluing, ultrasonic welding could be employed.

As in the pacifier of FIG. 18, this pacifier of FIG. 29 and other variations described below, have a two piece construction including a main body and a generally disc shaped member attached at a rear region of the main body. The generally disc shaped member defines the mouth of the shield to be a passageway connecting the interior lumen of the pacifier with outside space at the rear of the pacifier.

Thus, this variation of the pacifier, and other variations described below, are preferably molded as two parts:

1. A pacifier body with the handle, the nipple, the base and the shield; and

2. A disc to define the shield mouth (the final disc will not have the extensions as in FIG. 18 but will have an uninterrupted circular outer circumference).

Then these two parts are attached by gluing or ultrasonic welding as explained above.

The handle is optional unless needed to hold the disc.

Figure 30:
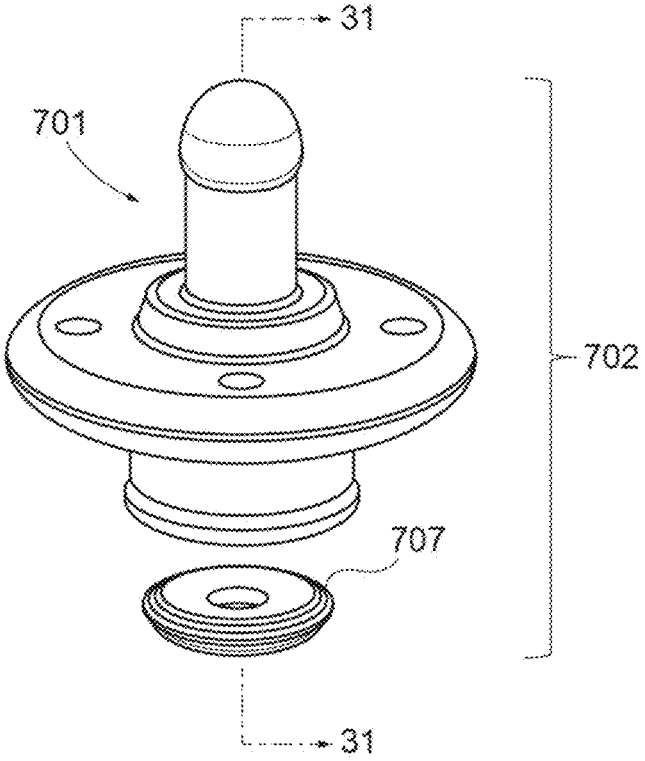
FIG. 30 shows an exploded perspective view of a pacifier, which is a modification of the pacifier of FIG. 28, which omits the locking ring and it glues or welds an annular partition (disc) of the pacifier having a circular perimeter with a rim into a channel (hidden in this figure) within a handle of the shield of the pacifier to contact the shield and define a shield mouth.

FIG. 30 shows an exploded perspective view of a pacifier 702, having a main body 701 and an annular partition (disc) 707. The pacifier 702 is a modification of the pacifier of FIG. 28 which omits the locking ring and it glues or welds the annular partition (disc) of the pacifier having a circular perimeter with a rim into a channel (hidden in this figure) within a handle of the shield of the pacifier 702 to contact the shield and define a shield mouth.

FIG. 31 shows an exploded view of a cross section of the pacifier 702 of FIG. 30 along view 31-31 of FIG. 30.

Figure 32:
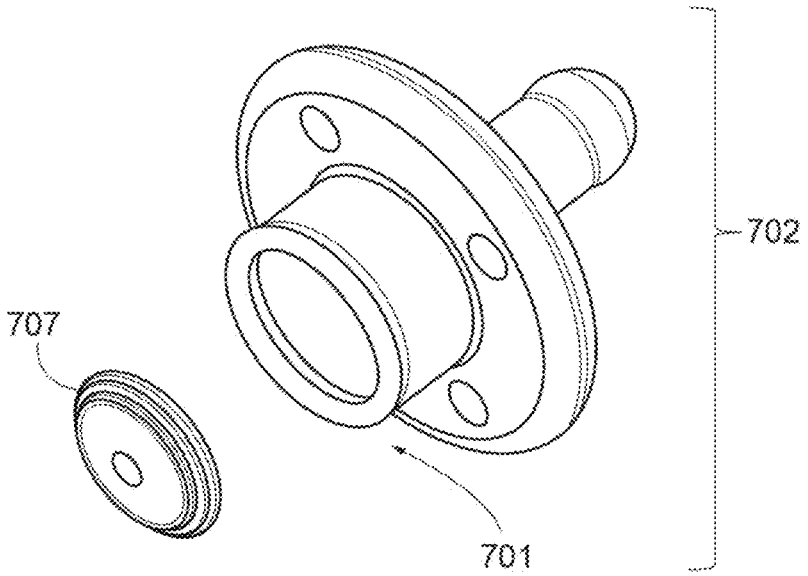
FIG. 32 shows a second exploded perspective view of the pacifier of FIG. 30.

FIG. 32 shows a second exploded perspective view of the pacifier 702 of FIG. 30.

Figure 33:
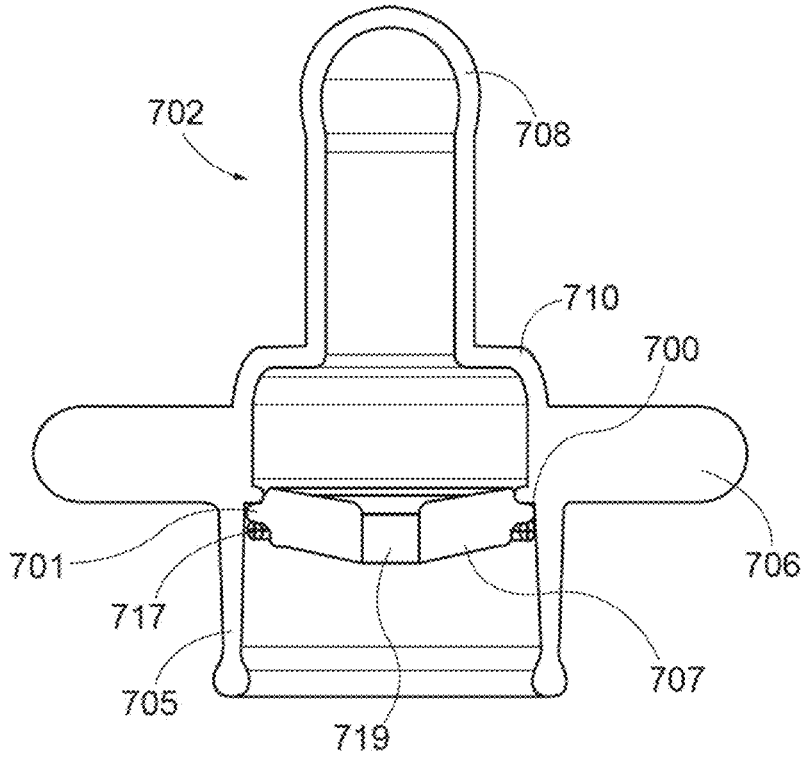
FIG. 33 shows the assembled pacifier of FIG. 30 along cross-sectional view FIG. 31-FIG. 31, which omits the locking ring and it glues or welds an annular partition (disc) of the pacifier having a circular perimeter with a rim into a channel within a handle of the shield of the pacifier to contact the shield and define a shield mouth.

FIG. 33 shows the assembled pacifier 702 of FIG. 30 along cross-sectional view 31-31. Pacifier 702 has a nipple stem 708, a base 710, a shield 706, and a handle 705 generally molded as one piece. However, pacifier 702 omits the locking ring and glues or welds an annular partition (disc) 707 having a circular perimeter with a rim 701 into a circumferential channel 721 within the handle 705 of the shield 706 of the pacifier 702 to contact an inner rim 700 of the lower surface of the shield 706. The annular partition (disc) 707 defines a shield mouth 719. The channel 721 is defined by the inner rim 700 the lower surface of the shield 706 and a rim 717 of the handle 705. Preferably, rim 701, the inner rim 700, and the rim 717 are continuous.

Figure 34:
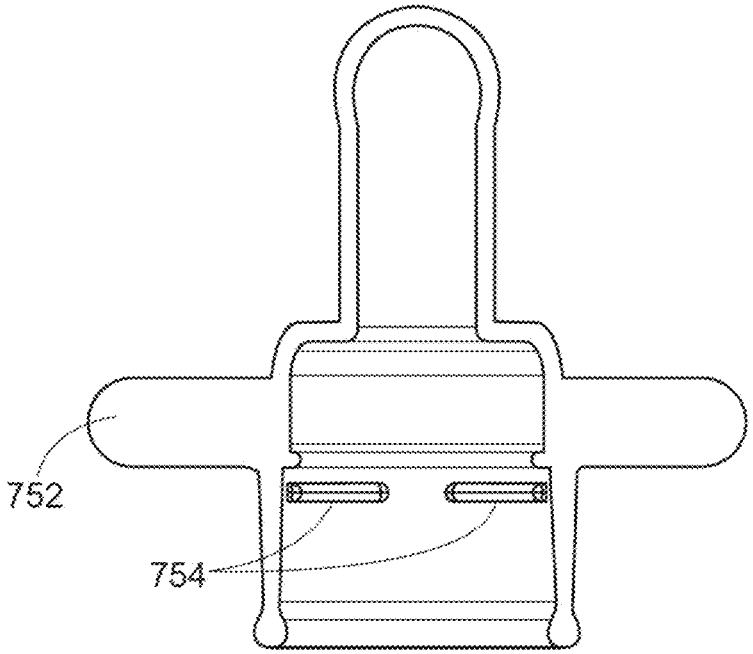
FIG. 34 shows the main body of the pacifier of FIG. 30 modified to have a discontinuous series of ridges rather than a continuous ridge forming the lower boundary of the channel for holding the annular partition (disc) of the pacifier.

FIG. 34 shows a main body 750 of the pacifier 702 of FIG. 30 modified to have a a discontinuous series of ridges 754 rather than a continuous ridge forming the lower boundary of the channel for holding the annular partition (disc) 707 of the pacifier.

Figure 35:
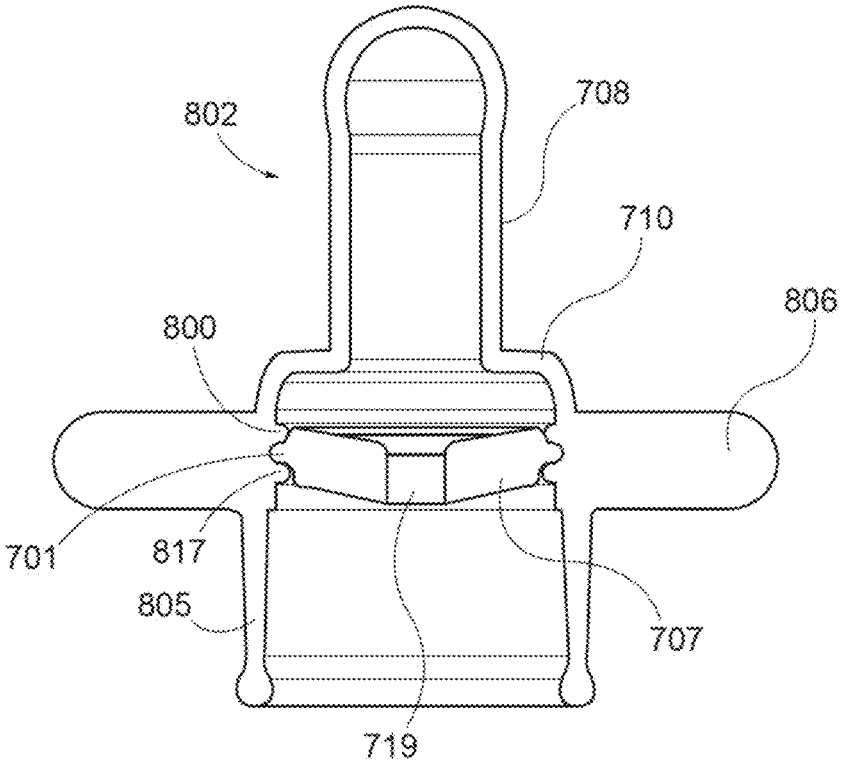
FIG. 35 shows a modification of the pacifier of FIG. 30 which glues or welds the annular partition (disc) of the pacifier having a circular perimeter with a rim into a channel within the main body of the shield, the annular partition (disc) of the pacifier defining the shield mouth.

FIG. 35 shows a pacifier 802 which is a modification of the pacifier of FIG. 30. It is the same as the pacifier of FIG. 30 (thus, like parts are not necessarily renumbered or labeled) except it glues or welds the annular partition (disc) 707 of the pacifier 802 having a circular perimeter with a rim 701 into a channel 821 within the shield 806. The annular partition (disc) 707 of the pacifier defines the shield mouth 719. The channel 821 is defined by a first inner rim 800 of the shield 806 and a second inner rim 817 of the shield 806. Thus the channel 821 is above the handle 805. Preferably, rim 701, the rim 800, and the rim 817 are continuous.

Figure 36:
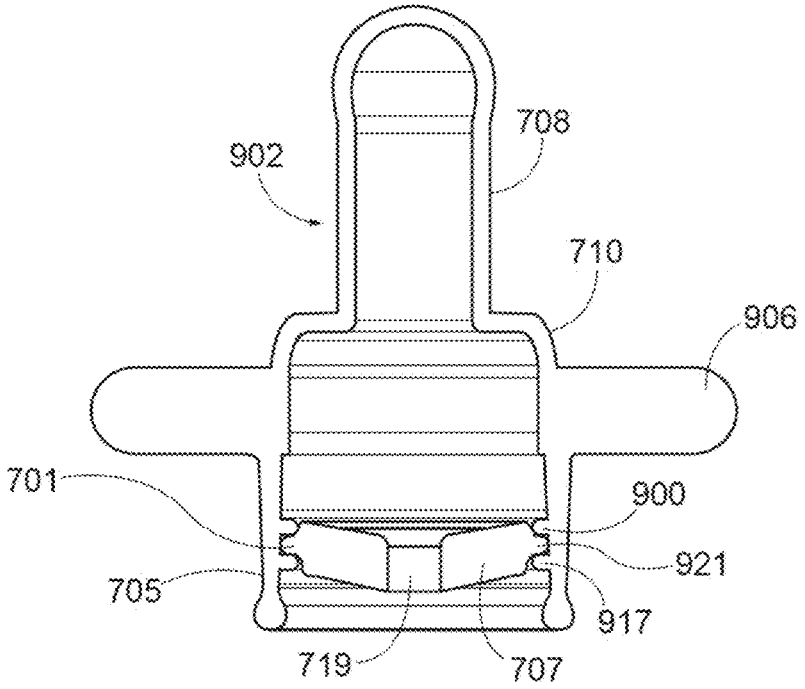
FIG. 36 shows a modification of the pacifier of FIG. 30 which glues or welds the annular partition (disc) of the pacifier having a circular perimeter into a channel within a handle of the pacifier below the main body of the shield, the annular partition (disc) of the pacifier indirectly connected to the shield via the handle, the annular partition (disc) of the pacifier defining the shield mouth.

FIG. 36 shows a pacifier 902 which is a modification of the pacifier of FIG. 30. It is the same as the pacifier of FIG. 30 (thus, like parts are not necessarily renumbered or labeled) except it glues or welds the annular partition (disc) 707 of the pacifier 902 having a circular perimeter with a rim 701 into a channel 921 within a handle 905 of the pacifier 902 below the shield 906. However, although spaced from the shield 906 the annular partition (disc) 707 of the pacifier 902 is deemed to define the shield mouth 719 because through the lumen of the handle it communicates with the lumen of the shield 906. The channel 921 is defined by a first inner rim 900 of the handle 905 and a second inner rim 917 of the handle 905. Thus the channel 719 is within the handle 905. Preferably, rim 701, the rim 900, and the rim 917 are continuous.

The pacifier of the present invention is preferably provided with a hollow elongated handle, typically a hollow cylindrical handle. Thus, the hollow cylindrical handle is a continuous 360 degree perimeter. FIGS. 18-36 show versions of the pacifier having this hollow cylindrical handle.

The base is optional for the pacifiers of the present invention provided with a hollow elongated handle.

The disc shaped partitioning insert (also termed in this application as a blocking wall, a disc, a washer or annular partition or generally disc shaped member) may also include one or more air holes, so as to superimpose one or more air holes in the shield. These are the air holes for a child to move air if intruded into their mouth, and not the hole(s) that would be a conduit to the nipple/stem. This permits use of a higher durometer material in the disc and with the disc being relatively larger to one that does not superimpose the air holes. This would make the shield stiffer and would therefore, by size and location, have to include one or more air holes.

Figure 37:
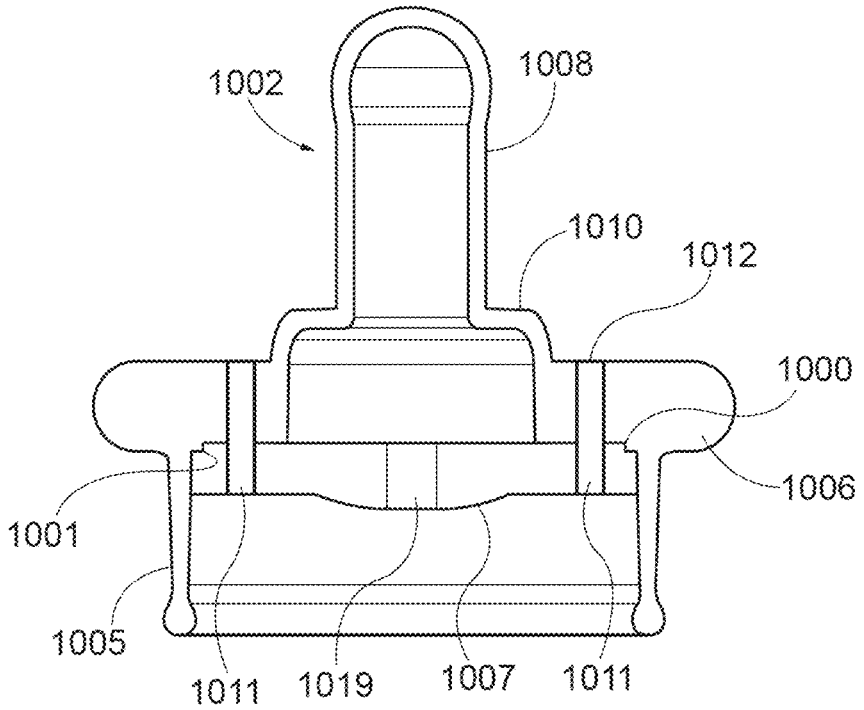
FIG. 37 shows a modification of the pacifier of FIG. 29 which uses a relatively larger annular partition (disc) having air holes aligned with air holes of the shield and, as in the pacifier of FIG. 29, it glues or welds the annular partition (disc) of the pacifier having a circular perimeter with an upper circular ledge within a handle of the pacifier to contact the shield and define a shield mouth.

For example, FIG. 37 shows a pacifier 1002 which is a modification of the pacifier 602 of FIG. 29 which uses a relatively larger annular partition (disc) having air holes aligned with air holes of the shield and, as in the pacifier of FIG. 29, it glues or welds the annular partition (disc) of the pacifier having a circular perimeter with an upper circular ledge within a handle of the pacifier to contact the shield and define a shield mouth.

The pacifier 1002 has an annular partition 1007 (also termed disc, a washer or generally disc shaped member) including two air holes 1011 aligned to superimpose two air holes 1012 in the shield 1006. Pacifier 1002 has a nipple stem 1008, a base 1010, the shield 1006, and a cylindrical handle 1005 generally molded as one piece. In the pacifier 1002 of FIG. 37, a lower portion of the shield 1006 provides a wall of an upper circular ledge 1001 (also known as a shelf). The pacifier 1002 glues or welds the annular partition (disc) 1007 having a circular perimeter with the upper circular ledge 1001 within the handle 1005 of the pacifier 1002 to contact the lower surface of the shield 1006. The annular partition (disc) 1007 defines a shield mouth 1019 (also known as a posterior opening). The ledge 1001 of the annular partition 1007 nests against a complimentary ledge 1000 of the shield 1006. The ledge 1001 and the complimentary ledge 1000 are continuous.

Pacifier 1002 of FIG. 37 employs the disc 1007 which has a substantially circular outer circumference. The generally disc shaped member 1007 will be secured into the ledge via "gluing" it with RTV silicone adhesive which is a liquid form of the same material as the pacifier, in this case medical grade silicone, and heating to form a bond. RTV silicone, or Room-Temperature-Vulcanization silicone, is a type of silicone rubber made from a two-component system of a base and a curative. Instead of gluing, ultrasonic welding could be employed. FIG. 37 shows the ledge 1000 of the shield 1006 positioned to place the annular partition 1007 partly in the cylindrical handle 1005 and partly in the shield 1006. However, the ledge 1000 of the shield 1006 can be positioned higher to place the annular partition 1007 entirely within the shield 1006 or lower to place the annular partition 1007 entirely within the cylindrical handle 1005.

Other versions of the pacifier of the present invention can also be modified to have a partition (also termed in the specification as a blocking member, a washer, an annular partition, disc or a generally disc shaped member) which may also include one or more air holes, so as to superimpose one or more air holes in the shield. For example, this modification (not shown) may be made to the pacifier 503 of FIG. 28 with the locking extensions of the generally disc shaped member 507. Also, this modification (not shown) may be made to the pacifier 702 which includes a channel in the circular handle, or the pacifier 802 which includes a channel in the shield, into which the disc shaped member is nested and secured.

Pacifier 1002 has a two piece construction including a main body and a generally disc shaped member attached at a rear region of the main body. The generally annular partition 1007 defines the mouth 1019 of the shield 1006 to be a passageway connecting the interior lumen of the pacifier 1002 with outside space at the rear of the pacifier 1002.

The handle could track the shape of the disc shaped partitioning insert or optionally the pacifier of the present invention could have a standard handle. However, the partitioning insert preferably tracks the shape of the shield. Being the same shape would add to stiffness if the shield.

The pacifier of the invention may have any shaped handle with any shaped partition. If the partition was positioned 100% within the handle, then the partition preferably has the same shape as the handle (FIG. 36). If the washer was positioned 100% within the shield (FIG. 35) then the washer is typically the shape of the mouth of the shield. However, the luminal diameter of the handle would be configured and large enough so that the washer could pass through luminal diameter of the handle to be secured into the retention grooves, wherever they are located. So, a large enough square handle may allow a circular washer to pass through.

One could make a pacifier with the elongated hollow handle in place, and no partition present. The elongated hollow handle itself has value to keep the pacifier in an upright position when placed down on a surface to increase cleanliness, as opposed to the shield making contact with a surface.

As mentioned above, the base is optional for the pacifiers of the present invention provided with a hollow elongated handle or a mouth. The base is also optional for the pacifiers of the present invention provided with a pacifier mouth posterior to the nipple, the pacifier mouth having a mouth diameter smaller than a largest transverse dimension of an internal surface of a lumen in a neck. The base is also optional for the pacifiers of the present invention provided with a pacifier mouth at a posterior end of the nipple, the pacifier mouth having a mouth largest transverse dimension smaller than a largest transverse dimension of the internal surface of the neck of the nipple FIG. 48 shows a version of the pacifier 1500 having the hollow cylindrical handle without a base.

Figure 48:
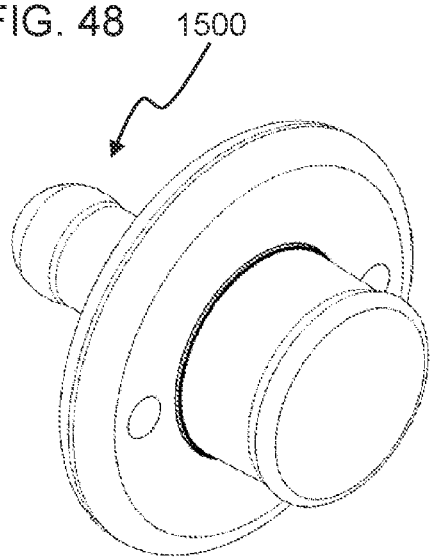
FIG. 48 shows a first perspective view of an embodiment of the pacifier of the invention having a hollow cylindrical handle without a base.

FIG. 48 shows a first perspective view of an embodiment of the pacifier 1500 of the invention having this hollow cylindrical handle 1504 without a base.

Figure 49:
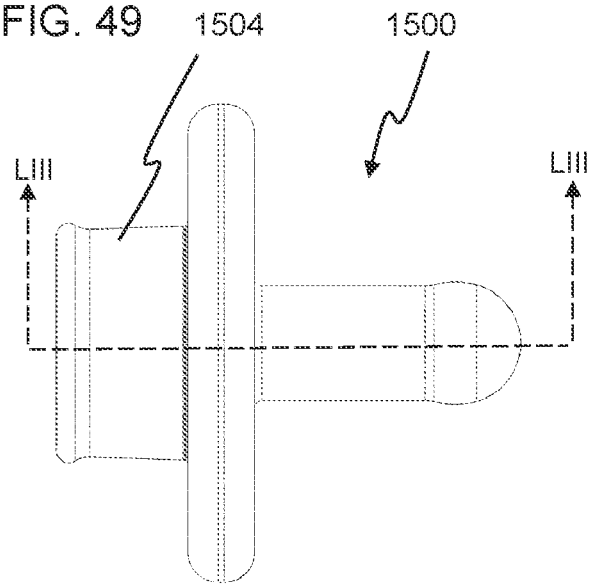
FIG. 49 shows a side view of the embodiment of the pacifier of FIG. 48 having this hollow cylindrical handle without a base.

FIG. 49 shows a side view of the embodiment of the pacifier 1500 of FIG. 48 having this hollow cylindrical handle without a base.

Figure 50:
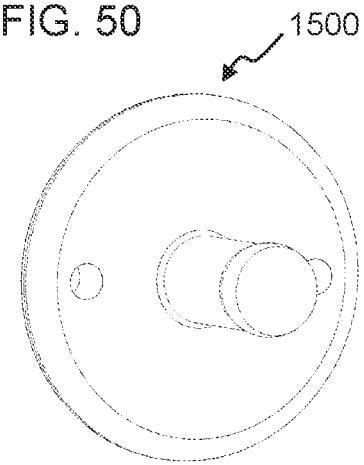
FIG. 50 shows a second perspective view of an embodiment of the pacifier of FIG. 48 having this hollow cylindrical handle without a base.

FIG. 50 shows a second perspective view of an embodiment of the pacifier 1500 of FIG. 48 having this hollow cylindrical handle 1504 without a base.

Figure 51:
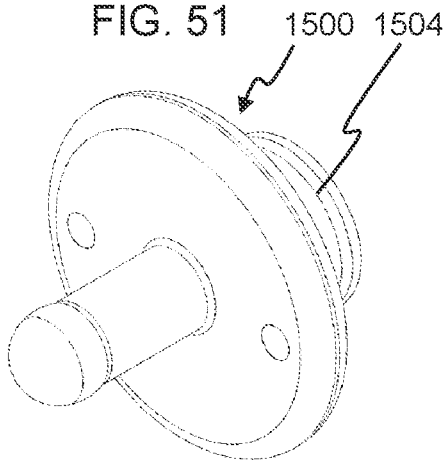
FIG. 51 shows a third perspective view of an embodiment of the pacifier of FIG. 48 having this hollow cylindrical handle without a base.

FIG. 51 shows a third perspective view of an embodiment of the pacifier 1500 of FIG. 48 having this hollow cylindrical handle 1504 without a base.

Figure 52:
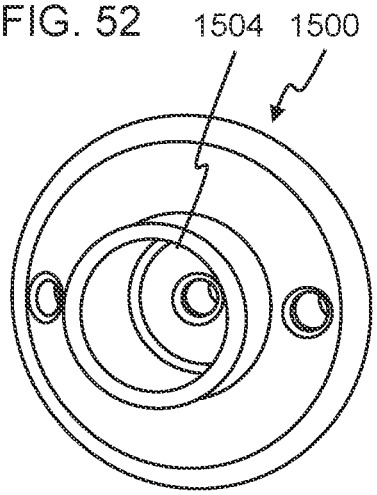
FIG. 52 shows a fourth perspective view of an embodiment of the pacifier of FIG. 48 having this hollow cylindrical handle without a base to show the inside of the hollow elongated handle.

FIG. 52 shows a fourth perspective view of an embodiment of the pacifier of FIG. 48 having this hollow cylindrical handle 1504 without a base to show the inside of the hollow elongated handle.

Figure 53:
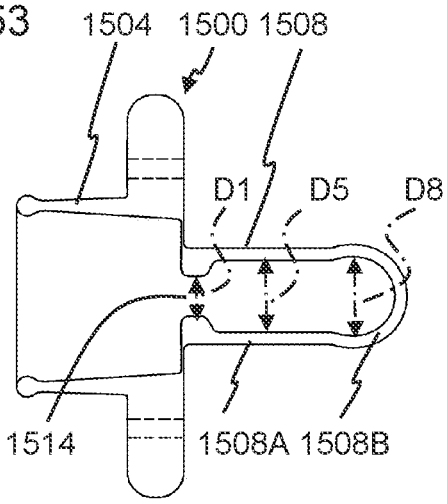
FIG. 53 shows a cross-sectional view along view LIII-LIII of FIG. 49 of an embodiment of the pacifier of FIG. 48 having this hollow cylindrical handle without a base.

FIG. 53 shows a cross-sectional view along view LIII-LIII of FIG. 49 of an embodiment of the pacifier 1500 of FIG. 48 having the pacifier stem (nipple) 1508, shield 1506, and hollow cylindrical handle 1504 without a base. This shows the pacifier stem (nipple) 1508 has an anterior neck portion 1508A and distal end head portion 1508B. This shows the pacifier mouth 1514 at the posterior end of the neck 1508A. The distal end head portion 1508B is closed. The pacifier 1500 defines a pacifier mouth 1514 within a posterior end of the nipple 1508. The pacifier mouth 1514 has a mouth diameter "D1" smaller than a largest transverse dimension "D5" of an internal surface of the posterior neck portion 1508A and smaller than a largest transverse dimension "D8" of an internal surface of the distal end head portion 1508B of the nipple 1508.

Figure 54:
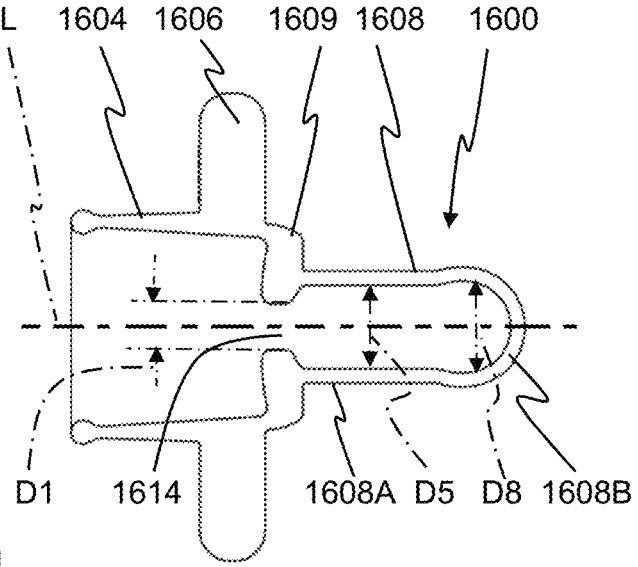
FIG. 54 shows a cross-sectional view of an alternative embodiment of the pacifier of the invention.

FIG. 54 shows a cross-sectional view of a pacifier 1600 having a longitudinal axis "L" which is a version of the pacifier 1500 of FIGS. 48-53 having the pacifier stem (nipple) 1608, shield 1606, and hollow cylindrical handle 1604 but modified to have a base 1609. This shows a pacifier stem (nipple) 1608 having an anterior neck portion 1608A and distal end head portion 1608B. This shows the pacifier mouth 1614 within the base 1609. The distal end head portion 1608B is closed. Thus, the pacifier 1600 defines a pacifier mouth 1614 posterior to the nipple 1608. The pacifier mouth 1614 has a mouth diameter "D1" smaller than a largest transverse dimension "D5" of an internal surface of the posterior neck portion 1608A and smaller than a largest transverse dimension "D8" of an internal surface of the distal end head portion 1608B of the nipple 1608.

The inner walls of the pacifier stem (nipple) 1608 lead to an upper wall 1609A of the base 1609 to form an angle Ω. The angle Ω is typically 90 to 160° , preferably tapered to be 91 to 135° , more preferably 95 to 135° , further more preferably 110 to 135° . Preferably the base 1609 has a maximum thickness T1 less than the maximum thickness T2 of the shield. For example, the base maximum thickness T1 is 40 to 60% of the shield maximum thickness T2.

Figure 55:
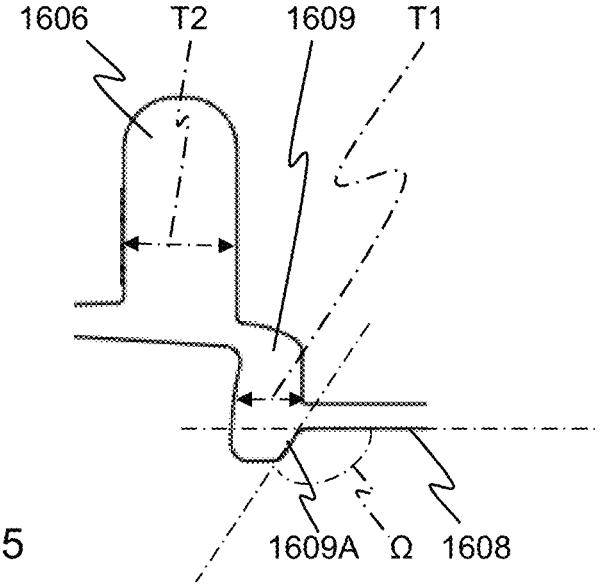
FIG. 55 shows an enlarged portion of the embodiment of FIG. 54.

FIG. 55 shows an expanded version of a portion of the pacifier 1600 of FIG. 54 with details removed for clarity to show angle Ω. It also shows the portion of the space within the base 1609 (lumen defined by interior walls of the base 1609) intermediate between the space within the neck 1608A and mouth 1614 tapers towards the pacifier mouth 1614 at the angle Ω. Thus, preferably a portion of the space within the base 1609 (lumen defined by interior walls of the base 1609) intermediate between the space within the neck 1608A and mouth 1614 tapers towards the pacifier mouth 1614.

Figure 56:
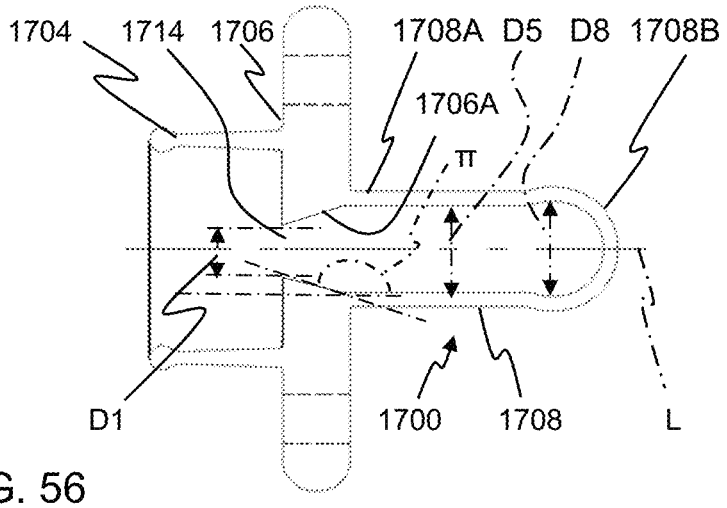
FIG. 56 shows a cross-sectional view of another alternative embodiment of the pacifier of the invention.

FIG. 56 shows a cross-sectional view of a pacifier 1700 having a longitudinal axis "L" which is a version of the pacifier 1500 of FIGS. 48-53 having the pacifier stem (nipple) 1708, shield 1706, and hollow cylindrical handle 1704 but modified such that the shield 1706 has a taper leading to the pacifier mouth 1714 at an angle π. Thus, the inner walls of the pacifier stem (nipple) 1708 lead to an upper wall 1706A of the shield 1706 to form an angle π. The angle π is typically 90 to 160°, preferably tapered to be 91 to 135°, more preferably 95 to 135°, further more preferably 110 to 135°.

This shows a pacifier stem (nipple) 1708 having an anterior neck portion 1708A and distal end head portion 1708B. This shows the pacifier mouth 1714 within the shield 1706. The distal end head portion 1708B is closed. Thus, the pacifier 1700 defines a pacifier mouth 1714 posterior to the nipple 1708. The pacifier mouth 1714 has a mouth diameter "D1" smaller than a largest transverse dimension "D5" of an internal surface of the posterior neck portion 1708A and smaller than a largest transverse dimension "D8" of an internal surface of the distal end head portion 1708B of the nipple 1708.

An Alternative Design is where the Nipple of the Pacifier Makes Direct Contact with the Shield where a Base does not Exist An alternative design (not shown) is where the nipple of the pacifier makes direct contact with the shield where a base does not exist and wherein the shield would intersect the stem of the nipple at an angle β (beta) of 55 to 120 degrees.

This would provide a pacifier comprising:

a shield and a nipple, wherein the nipple comprises a stem for insertion into an infant's mouth and a closed distal end, the stem having longitudinal sidewalls, the shield and the stem being longitudinally aligned, the nipple extending longitudinally from the shield;

wherein a top wall of the shield intersects the stem of the nipple at an angle β (beta) of 55 to 120 degrees, wherein the nipple and shield define a hollow lumen comprising a nipple portion of the lumen and a shield portion of the lumen. The angle β (beta) is defined as the angle on the right hand side of a longitudinal axis of the pacifier below a slope line of the top wall of the base of the pacifier as viewed when facing the pacifier with its nipple oriented upwardly.

Another Variation of the Pacifier of the Present Invention has a Base Whose Configuration is not Defined by its Lumen Another variation of the pacifier of the present invention has a base whose configuration is not defined by its lumen and therefore possesses a greater amount of silicone in its respective area. The advantage to this configuration is that it will allow the core of the tooling, which dictates and defines the luminal dimensions, to pass through the smaller opening at the most proximal end of the shield during the production cycle. The typical internal diameter, typically 22-26 mm, of a base whose configuration is defined by its lumen will not permit the core to be extracted from the pacifier without tearing of the shield.

A core which is approximately 8 mm in diameter tapering proximally down to 5 mm in diameter can be extracted through an approximate 5 mm opening in the shield. The advantage to this design is that the pacifier can be made as a one piece (uni-mold) pacifier as compared to embodiments of the invention providing a two piece pacifier with a disc (partition) attached to the pacifier to define the pacifier mouth. The decrease in the luminal open space volume, as compared to a base that is defined by its lumen, will make the shield of the pacifier and the pacifier overall much stiffer and more dense. This is a safety factor such as there would be less flexing of the shield which would make intrusion into a child's mouth more likely to occur.

Another advantage to a solid base, not defined by its lumen, is that it is thicker than a base defined by the lumen. Thus, the solid base, not defined by its lumen, permits construction of a nipple that may be inverted even further into the base with the same material, wall thicknesses and durometer such that if a child would pull the nipple distally towards them, the nipple would not remain everted. With a solid communication of the nipple to the base the nipple would typically be more likely to return to its inverted resting position.

The invention with the solid base includes a pacifier comprising:

a shield, a base, and a nipple, wherein the nipple extends longitudinally from the base, wherein the base extends longitudinally from the shield, wherein the nipple and shield define a hollow lumen comprising a nipple portion of the lumen and a shield portion of the lumen, wherein the nipple portion of the lumen defines internal surface of the nipple, and wherein the pacifier defines a mouth posterior to the nipple the mouth having a mouth largest transverse dimension, typically a diameter, smaller than a largest transverse dimension of the internal surface of the nipple.

The use of the term diameter in this specification does not require the mouth to be a circular opening, although typically the mouth is a circular opening. A diameter is a straight line passing from side to side through the center of a body or figure, especially but not necessarily a circle. Thus, it is equivalent to mouth largest transverse dimension.

Thus, this pacifier has at least one mouth (also termed a shield, rear or posterior mouth) which is posterior to the nipple, each shield mouth having a mouth diameter smaller than an internal diameter of the nipple portion of the lumen and in communication with the hollow lumen.

Preferably this provides a pacifier comprising a shield, a base, and a nipple, wherein the nipple extends longitudinally from the base, wherein the base extends longitudinally from the shield, wherein the base extends transversely from the nipple, wherein the nipple and shield define a hollow lumen comprising a nipple portion of the lumen and a shield portion of the lumen, and wherein the pacifier defines a mouth posterior to the nipple, the mouth having a mouth largest transverse dimension (typically a diameter) smaller than a largest transverse dimension (typically a diameter) of the internal surface of the nipple neck portion and smaller than a largest transverse dimension (typically a diameter) of the internal surface of the nipple distal head portion.

The pacifier may comprise the shield having a posterior wall comprising the posterior surface.

The pacifiers of the invention may have a handle which is a hollow elongated handle having continuous sidewalls defining a handle portion of the hollow lumen, wherein the continuous sidewalls have a continuous perimeter, wherein the hollow elongated handle extend posteriorly from the shield, wherein the hollow elongated handle is integral with the shield, wherein the handle portion of the hollow lumen is aligned with the mouth, wherein the hollow elongated handle has an open posterior end.

Additional Inventive Aspects

Figure 38:
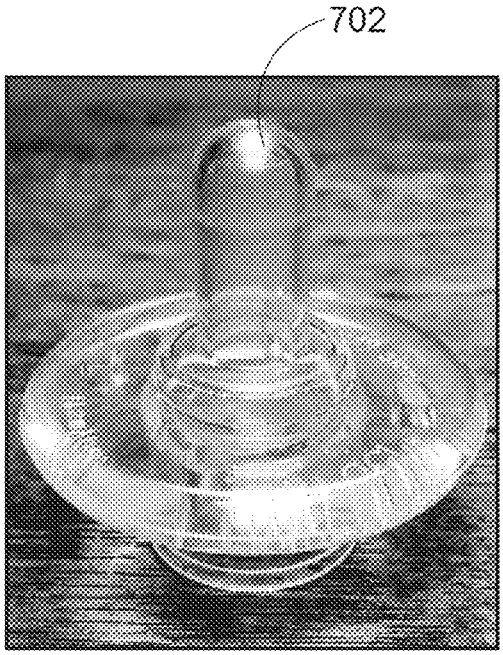
FIG. 38 is a perspective view photograph of a pacifier of the present invention of FIGS. 33 and 34.

FIG. 38 is a perspective view photograph of a pacifier of the present invention. In particular FIG. 38 is a perspective view photograph of a pacifier 702 of the present invention of FIGS. 33 and 34.

Figure 39:
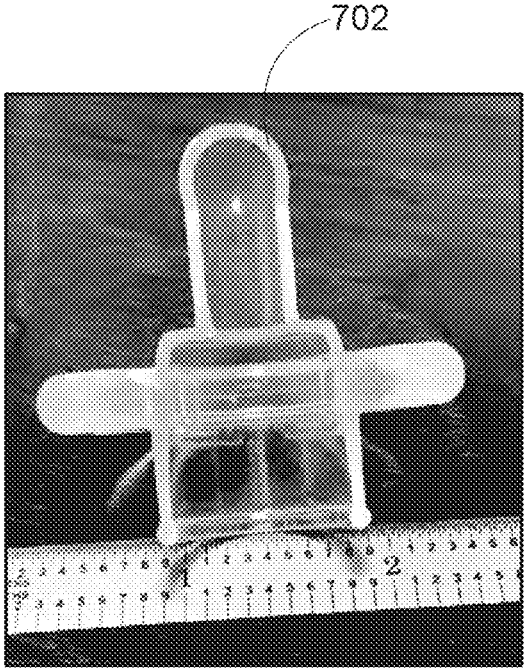
FIG. 39 is a cross sectional photograph of a pacifier of the present invention of FIGS. 33 and 34 prior to including the partition.

FIG. 39 is a cross sectional photograph of a pacifier of the present invention of FIG. 38.

FIGS. 18-39 show the hollow elongated handle of the pacifier as a cylindrical 360 degree handle. However, the shape of the hollow elongated handle preferably tracks the shape of the disc shaped partitioning insert of the present invention. Thus, if the pacifier has an orthodontic shaped stem/nipple, the disc shaped partitioning insert and the hollow 360 degree handle would be more oblong or elliptical than annular or circular.

In general the hollow elongated handle is a part of the shield and not a part of the disc shaped partition. This makes the handle and shield as a uni-molded design which is stiffer than a separate handle and shield and therefore safer for a child using the pacifier. Preferably the nipple, base, handle and shield are a uni-molded design. Also if the handle is a "part" of the shield it would be the same durometer of the shield. Likewise, if the nipple, base, handle and shield are a uni-molded design then they would be the same durometer. If the handle was part of the disc shaped partition, and the disc shaped partition was a higher durometer, the handle may be too stiff to collapse if a child fell on his or her face. Such as overly stiff handle could push the pacifier into the mouth of the child in the event of the fall.

Thus, having the hollow handle as a part of the shield and not a part of the disc permits making the washer as stiff as possible and adding a different desired level of stiffness to the shield such that the handle is "soft" enough to be safe and still useful. The stiffer disc also allows permits manufacture of a "softer" shield which results in a softer stem/nipple which will have less of a negative effect on the oral cavity.

Another advantage of having the handle not connected to the disc shaped partitioning insert is that the disc shaped partitioning insert can be made smaller if air holes are not being incorporated into the disc shaped partitioning insert or made larger if air holes are being incorporated into the disc shaped partitioning insert.

A number of the above-described figures show the disc shaped partitioning insert with a circular perimeter. However, the disc shaped partitioning insert does not necessarily have a circular perimeter.

Also, having the disc shaped partitioning insert track the shape of the hollow elongated handle enables the present invention to be made as a uni-molded pacifier having two or more, typically four, air holes. The hollow elongated handle and the disc shaped partitioning insert which tracks the shape of the hollow elongated handle also enables and imparts better support of the shield since it is the same shape as the shield. Thus, preferably in the present invention the disc shaped partitioning insert tracks the shape of the shield and the handle is not connected to the disc shaped partitioning insert.

Figure 40:
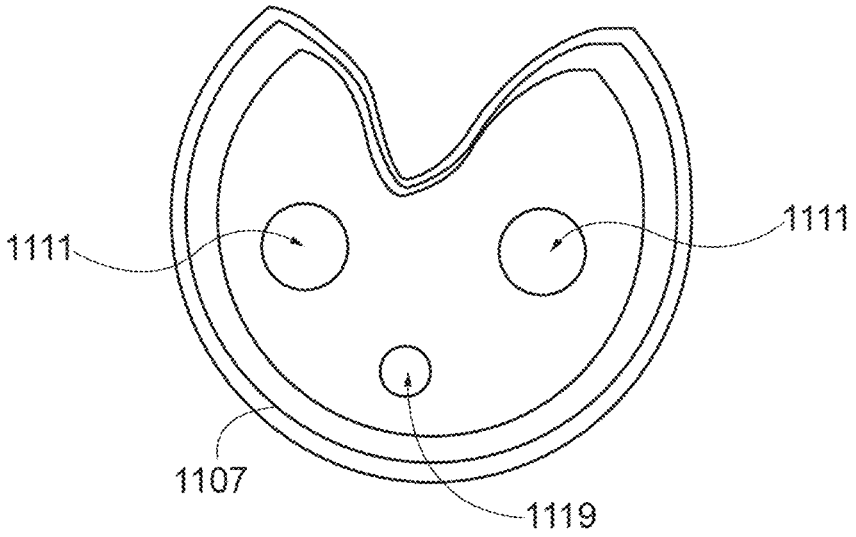
FIG. 40 shows a U-shaped partition of a pacifier of the present invention having two air holes and a passageway to the base and nipple lumen.
Figure 41:
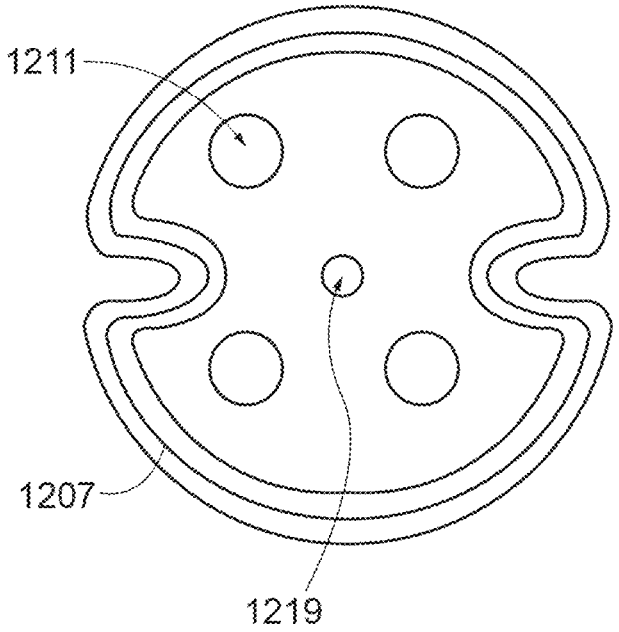
FIG. 41 shows a butterfly-shaped partition of a pacifier of the present invention having four air holes and a passageway to the base and nipple lumen.

If desired the pacifier may substitute the round shaped disc shaped partitioning insert shown in a number of the figures described above with a disc shaped partitioning insert of a shape other than round. For example, the disc shaped partitioning insert may be may be elliptical (not shown) or square (not shown). For example, the disc shaped partitioning insert may be U-shaped as in disc shaped partitioning insert 1107 of FIG. 40 having two air holes 1111 and a passageway 1119 to the base and nipple lumen. For example, the disc shaped partitioning insert may be butterfly-shaped as in disc shaped partitioning insert 1207 of FIG. 41 having four air holes 1211 and a passageway 1219 to the base and nipple lumen.

Figure 42:
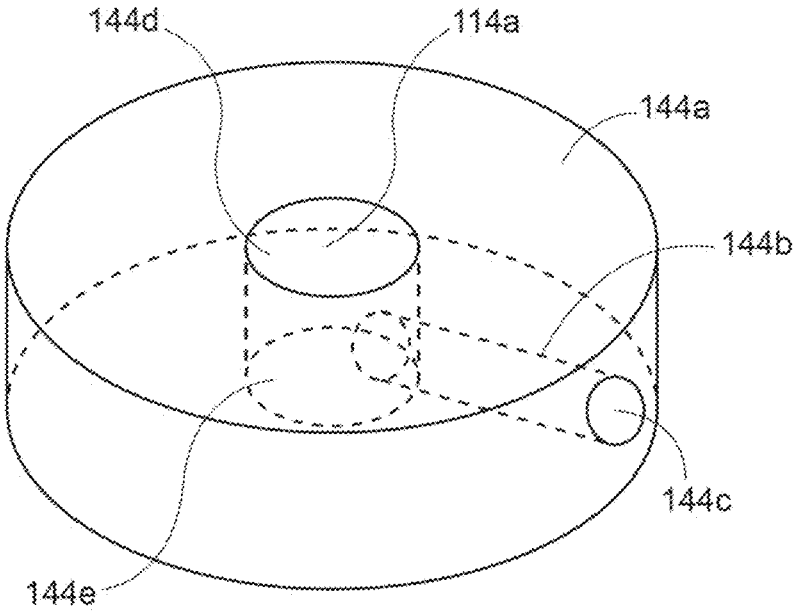
FIG. 42 shows a disc shaped partitioning insert as an annular disc that has a side opening and can be used at the posterior of the pacifier shield.

FIG. 42 shows an enlarged view of an annual shaped partition (disc) 144*a* which is the annual shaped partition (disc) 144 of FIG. 6A modified to have a side channel 144*b* leading from the central channel for the opening or mouth 114*b* to a side opening 144*c*. The opening or mouth 114*a* may pass entirely through the annual shaped partition (disc) 144*a* from an opening at the anterior end 144*d* to an opening at the posterior end 144*e*. In the alternative the opening or mouth 114*a* may pass from the opening at the anterior end

144*d* through enough of the annual shaped partition (disc) 144*a* to reach the side channel 144*b* and then the posterior end 144*e* is closed. Although only one side channel 144*b* and side opening 144*c* is shown, there may be more than one side channel 144*b* and side opening 144*c*.

Figure 43:
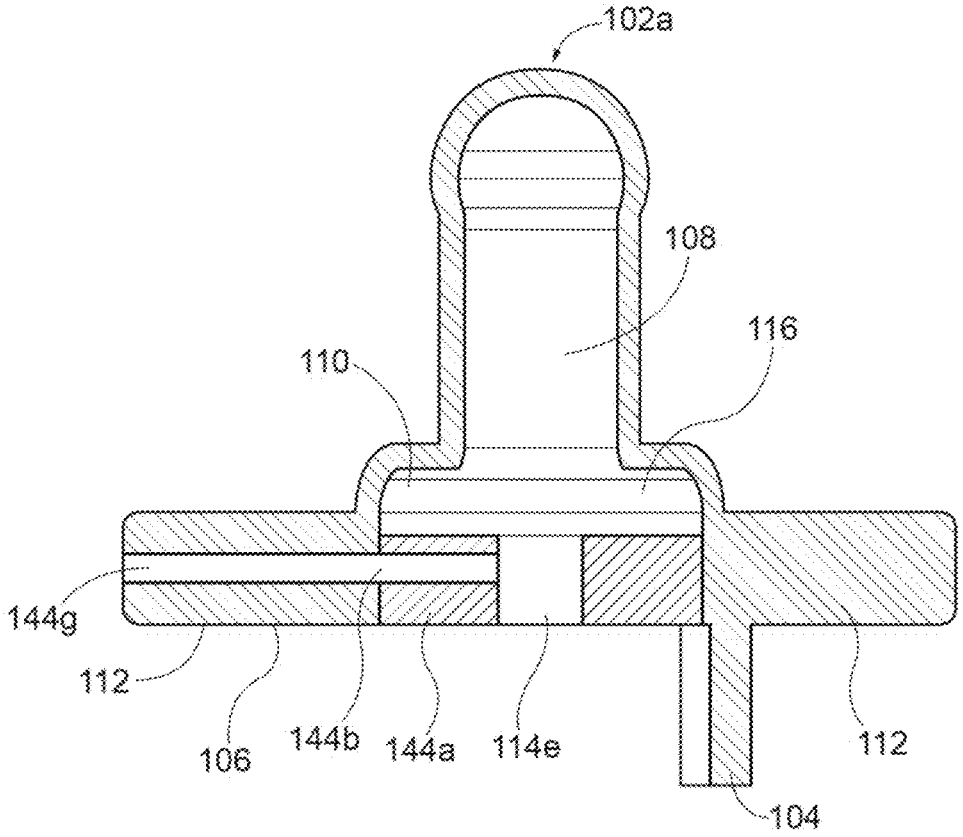
FIG. 43 illustrates a cross-section along view 7A-7A of the pacifier shown in FIG. 3 employing the innovative shield of the pacifier shown in FIG. 3, having a base with 90 degree angle shoulders where the shoulders meet the nipple stem, and modified to employ the disc shaped partitioning insert of FIG. 42 having a side opening.

FIG. 43 shows a side view of the pacifier 102*a* which is the pacifier 102 of FIG. 7A modified to include the annual shaped partition (disc) 144*a* (also known as a disc shaped partitioning insert) of FIG. 42. Relative to FIG. 7A like elements are like numbered, but the drawing of the pacifier 102*a* is simplified for clarity. Pacifier 102*a* has the annual shaped partition (disc) 144*a* having a side channel 144*b* leading to the side opening 144*c*. The side opening 144*c* leads to another shield side channel 144*g* in a shield 106*a* having air holes 112*a* (one shown) of the pacifier 102*a*. The posterior end 144*e* may be open or closed. If the annual shaped partition (disc) 144*a* of FIG. 42 has more than one side opening 144*c*, the shield 112*a* would have complimentary additional shield side channels 144*g*.

Likewise the annual shaped partition (disc) 144*a* of FIG. 42 can be placed inside the handle of a pacifier, for example the handle 705 of the pacifier 902 of FIG. 36 or the pacifier 1002 of FIG. 37 so long as the handle is modified to have a side opening aligning with the side opening 144*c* to provide a side passage from the mouth 144*a* to the side opening of the handle.

If desired in a modification not shown, the annual shaped partition (disc) 144 of FIG. 6A or the annual shaped partition (disc) 144*a* of FIG. 42 can be placed in the lumen of the base 110 to fill all or the entire base lumen. If the annual shaped partition (disc) 144*a* of FIG. 42 having the side opening 144*c* were employed the base sidewalls would have to have a complimentary side channel and opening leading from the side opening 144*c* through the side wall of the base. If the annual shaped partition (disc) 144*a* of FIG. 42 has more than one side opening 144*c*, the base side walls would have complimentary additional side channels and openings leading from the side opening 144*c* through the side wall of the base.

Figure 44:
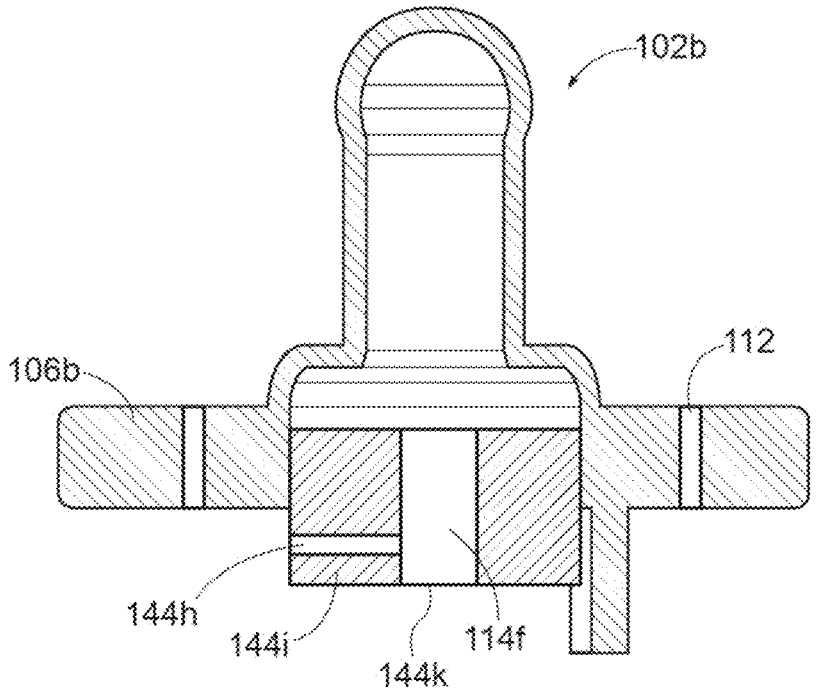
FIG. 44 illustrates a cross-section of the pacifier shown in FIG. 43 but modified to employ the disc shaped partitioning insert of FIG. 42 modified to have a side opening from an extended disc shaped partitioning insert.

FIG. 44 illustrates a cross-section of a pacifier 102*b* which is the pacifier shown in FIG. 43 but modified to employ a disc shaped partitioning insert 144*i* (annual shaped partition (disc)) which is an extended version of the disc shaped partitioning insert of FIG. 42 such that the disc shaped partitioning insert 144*i* extends beyond the posterior of the shield 106*b* to expose a side opening 144*h*. The opening or mouth 114*f* of the partitioning insert 144*i* may pass entirely through the partitioning insert 144*i* from an opening at the anterior end to an opening at the posterior end 144*k*. In the alternative, the opening or mouth 114*f* may pass from the opening at the anterior end through enough of the partitioning insert 144*i* to reach the side channel 144*h* and then the posterior end 144*k* is closed. Although only one side channel 144*h* is shown, there may be more than one side channel 144*h*. The disc shaped partitioning insert 144*i* would be attached, typically by adhesive or ultrasonic welding, to the shield 106*b*.

Figure 45:
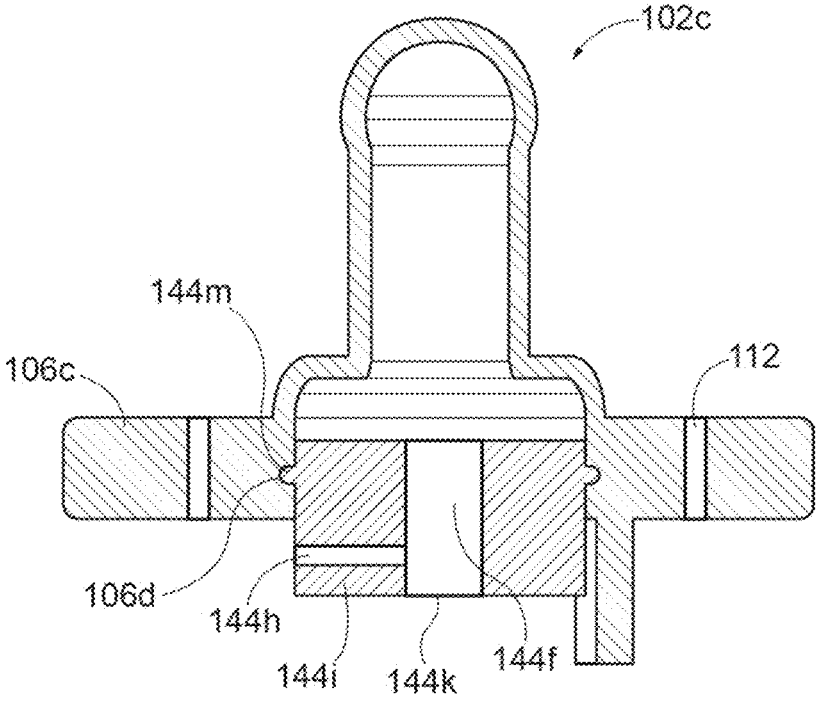
FIG. 45 illustrates a cross-section of the pacifier shown in FIG. 44 but modified such that the disc shaped partitioning insert (annual shaped partition (disc)) has a rim that mates with a groove of the shield.

FIG. 45 illustrates a cross-section of a pacifier 102*c* which is the pacifier shown in FIG. 44 but the disc shaped partitioning insert 144*i* (annual shaped partition (disc)) has a rim 144*m* that mates with a groove 106*d* of the shield 106*c*. The disc shaped partitioning insert 144*i* of FIG. 45 would be attached, typically by adhesive or ultrasonic welding, to the shield 106*c*. Rim 144*m* may extend about a continuous perimeter of the disc shaped partitioning insert 144*i* or extend discontinuously about the perimeter of the disc shaped partitioning insert 144*i*.

When the present specification says a first part "tracks" the shape of a second part this means if the first part has a perimeter shape, for example circular, elliptical or rectangular, the second part has the same type perimeter shape. In other words, the second part perimeter parallels the first part perimeter. For example, if the first part has a perimeter shape which is U-shaped, butterfly shaped, circular, elliptical or rectangular, then second part has a perimeter shape which is, respectively, U-shaped, butterfly shaped, circular, elliptical or rectangular. However, the dimensions of the shape are not necessarily the same. Thus for example, if the partition tracks the shape of the shield and the shield has a circular shape then the partition has a smaller circular shape. If the partition tracks the shape of the hollow elongated handle then if the hollow elongated handle has a circular shape then the partition has a circular shape.

Figure 46:
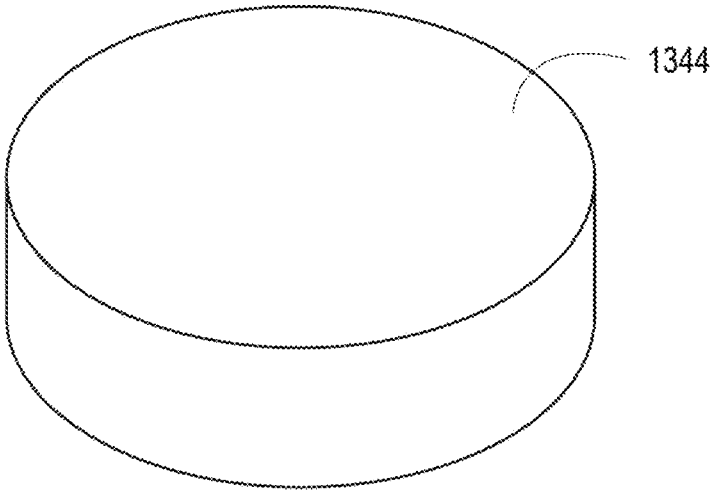
FIG. 46 shows an enlarged view of a partition (disc) which is the annual shaped partition (disc) of FIG. 6B without a pacifier rear opening.

FIG. 46 shows an enlarged view of the partition (disc) 1344 which is annual shaped partition (disc) 144 of FIG. 6B without the pacifier rear opening 114.

Any pacifiers of the present invention can be modified to omit the rear opening, or any other opening in communication with the lumen, to close a rear portion of the pacifier hollow lumen. Thus, any pacifiers of the present invention having annual shaped partition (disc) can be modified to substitute partition (disc) 1344 for the annual shaped partition (disc). Any of annual shaped partition (disc) 144, 444, 507, 607, 707, 1007, 1107, 1207, 144*a*, and 144*i* can be modified to not have an opening in communication with the lumen. For example, partition (disc) 1344 can replace any of the pacifiers of the present invention having annual shaped partition (disc) 144, 444, 507, 607, 707, 1007, 1107, 1207, 144*a*, and 144*i*.

Figure 47:
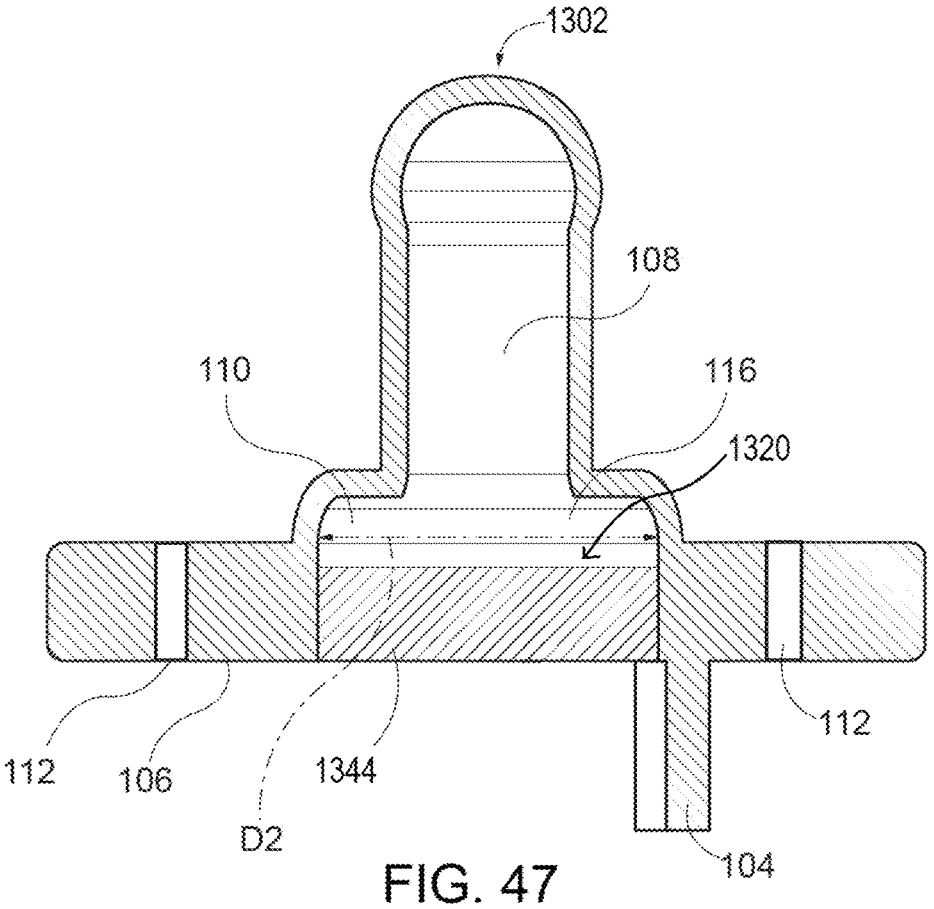
FIG. 47 shows a cross section of a pacifier which is the pacifier of FIG. 7A modified to substitute the partition (disc) of FIG. 46 for the annual shaped partition (disc) of FIG. 6B.

For example, FIG. 47 shows a cross section of pacifier 1302 which is the pacifier 102 of FIG. 7A modified to substitute the partition (disc) 1344 for the annual shaped partition (disc) 144 of FIG. 6B (thus, like parts retain like reference numerals relative to FIGS. 6B and 7A. FIG. 47 represents a cross-section of a mid-plane of the pacifier when viewed from the front. The stem 108, base 110 and shield 106 together define a hollow interior (lumen). FIG. 47 shows the diameter D2 of the lumen 116 of the base 110. The pacifier 1302 is molded in a first stage to have a large posterior mouth and subsequently in a second stage is molded to form the annular disc 1344 by a second shot of polymer or other molding material. Thus, the core (not shown) used during the first stage of molding of the pacifier 2 is removed from the pacifier's mouth because, as happens with molding of a "conventional" mouth 15 (FIG. 1), there is no negative draft. However, the present pacifier 2 has more center mass. In the alternative the pacifier 1302 is molded in a first stage to have a large posterior mouth and subsequently in a second stage the partition disc 1344 is inserted into the large posterior mouth and attached to the shield 106, for example by ultrasonic welding or gluing (adhesive). The partition disc 1344 omits the rear opening of annular partition 144 to close a rear portion 1320 of the pacifier hollow lumen.

Materials of Construction

The pacifier is made of a resilient or elastic compressible material. Preferably it is made of polymer plastic, medical grade rubber, silicone rubber, latex or other conventional pacifier material, most preferably medical grade silicone rubber. Preferably the pacifier material does not contain Bisphenol-A. By polymer plastic it is meant a material that is compounded and can be processed by flow. Most preferably it is made of silicone rubber. Preferably the pacifier material does not contain dye.

The nipple, base and shield should have a Shore A hardness of 20-70 durometer. The partition, if present, should also have a Shore A hardness of 20-70 durometer. The partition typically has hardness equal to or harder than the nipple, base and shield, preferably harder, which adds rigidity to the shield. For example the partition, if present, can have have a Shore A harness of 0-15 or 5-15 durometer less than the nipple, base and shield. For example, the pacifier product may have a nipple, base and shield with a Shore A hardness of 40 or 50 durometer and an insert with a Shore A hardness of 50 durometer. 40 Durometer gives us a "softer" stem/nipple while the 50 Durometer insert helps to add overall more stiffness to the shield than a 40 Durometer insert would.

In this specification the term embodiment or version is not to be taken as limiting per se. Any feature of any embodiment or version of the pacifier of the present invention may apply to any other embodiment or version of the invention unless the feature is impossible to include or mutually exclusive relative to expressly disclosed features of the other embodiment or forbidden in view of expressly disclosed features of the other embodiment. These features apply to the invention in general and are not limited to the embodiment or version for which they are particularly described unless apparent that they are so limited. For example, any features of the embodiments or versions of the pacifier involving the parts to provide above-noted alpha and beta angles can be combined with any features of the embodiments or versions of the pacifier involving the smaller posterior mouth and vice versa, unless the feature is impossible to include or mutually exclusive relative to expressly disclosed features of the other embodiment or forbidden in view of expressly disclosed features of the other embodiment.

Processes to Make the Pacifier

The invention is made in a mold with a core. The core is a device that produces the internal cavity in the product. The mold makes the "outside" of the pacifier and the core makes the "inside," but has to be pulled or blown out at the end of the process. To get the core out of the product negative draft (undercuts) or even zero draft (parallel walls) are to be avoided or compensated.

The largest transverse outer dimension of the base of the present pacifier is larger, typically about 20 to about 120% larger, than the largest transverse outer dimension of the nipple of the present pacifier. Likewise, the largest transverse inner dimension of the base of the present pacifier is larger, typically about 20 to about 150% larger or about 20 to about 120% larger, than the largest transverse inner dimension of the nipple. These relative largest transverse inner dimensions make a pacifier made of only one piece to provide the present pacifier with a posterior surface with only a relatively small axial opening has a negative draft during manufacture making it more difficult to fabricate. There are a number of ways to compensate for this negative draft.

One way to compensate for this problem is to employ the insert. This is done by a two shot mold process. A second piece, the partition (for example the "annular disc" 144) is shot molded in a second step in the molding process. The advantage is that you can have as thick walls as you want to. The annular disc 144 could be as thick at the shield.

For a one piece pacifier made by a one shot mold process this may be handled by one or more of the following:

Employing materials with sufficiently high tear strength.

Employing the trough 220 (FIG. 8) that will allow the wall around the mouth 214 to flex, and with enough pull or blowing force, get the core out. So, with the shield floor (for example shield floor 211 below the lumen 216) at 1-4 mm thick, preferably at 1.5-3 mm thick, the mouth 314 would expand and the trough would allow more flex in the whole floor around the mouth 314 to extract the core.

Making the pacifier to have a hollow frustoconical shaped funnel around the posterior mouth (for example frustoconical shaped funnel 340 (FIG. 10) about posterior mouth 314). The walls of the frustoconical shaped funnel around the posterior mouth are sufficiently thin and flexible such that the walls can expand so a core, with negative draft can be removed.

As explained above for versions of the pacifier employing a partition (disc) to provide the mouth for the pacifier lumen, the main body is one molded part and the disc is a second molded part. The disc is preferably attached to the main body (including the nipple, base, shield and handle, if present) of the pacifier by gluing (adhesive) or ultrasonic welding. Most preferably the disc is attached to the main body of the pacifier by gluing.

Clauses Describing Invention Aspects

Clause 1. A pacifier comprising:

a shield, a base, and a nipple, the nipple comprising a stem for insertion into an infant's mouth and a closed distal end, the stem having longitudinal sidewalls, the shield, the base, and the nipple being longitudinally aligned, the base extending longitudinally from the shield, the nipple extending longitudinally from the base;

the base having a top wall, the top wall of the base having a slope line which intersects a longitudinal axis of the stem at an angle β (beta) of 55 to 120 degrees, wherein the nipple, base, and shield define a hollow lumen comprising a nipple portion of the lumen, a base portion of the lumen, and a shield portion of the lumen.

Clause 2. The pacifier, according to clause 1, wherein the stem comprises relatively cylindrical or flat sidewalls having a surface which makes contact with the base at an angle theta (θ) within ±5% of angle β (beta) and wherein angle β (beta) is at least greater than 90 to at most 100 degrees.

Clause 3. The pacifier, according to clause 1, wherein the stem comprises relatively cylindrical or flat sidewalls having a surface which makes contact with the base at an angle theta (θ) equal to angle β (beta), wherein angle β (beta) is at least greater than 90 to at most 100 degrees to invert the proximal end of the stem into the base.

Clause 4. The pacifier of claim 1, wherein the pacifier defines a posterior mouth having a mouth diameter smaller than an internal diameter of the base portion of the lumen.

Clause 5. The pacifier, according to claim 1, wherein the shield defines a shield mouth on the posterior surface of the shield, the shield mouth having a mouth diameter smaller than an internal diameter of the base portion of the lumen, wherein the shield has a posterior wall comprising the posterior surface, the shield posterior wall having a trough that circumferentially surrounds the shield mouth.

Clause 6. The pacifier, according to claim 1, wherein the posterior surface of the shield opens into a funnel shaped conduit defining a shield mouth and is circumferentially encompassed by a trough, the shield mouth having a mouth diameter smaller than an internal diameter of the base portion of the lumen.

Clause 7. The pacifier of clause 1, wherein the base portion of the lumen defines internal surface of the base, and wherein the pacifier defines a mouth posterior to the base, the mouth having a mouth diameter smaller than a largest transverse dimension of the internal surface of the base.

Clause 8. The pacifier according to any of clauses 1, 2, 3, 4 or 7, further comprising a hollow elongated handle having continuous sidewalls defining a handle lumen having a continuous perimeter, the hollow elongated handle extending posteriorly from the shield, wherein the hollow elongated handle is integral with the shield, the hollow elongated handle having an open posterior end.

Clause 9. The pacifier, according to clause 1, wherein the shield, the base, and the nipple are a uni-molded pacifier single unitary piece.

Clause 10. The pacifier, according to clause 1, wherein the shield, the base, and the nipple are a uni-molded pacifier single unitary piece of silicone.

Clause 11. The pacifier, according to clause 9, wherein the stem comprises relatively cylindrical or flat sidewalls having a surface which makes contact with the base at an angle theta ($\theta$) within ±5% of angle $\beta$ (beta) and wherein angle $\beta$ (beta) is 92 to 120 degrees.

Clause 12. A pacifier comprising a shield, a base, and a nipple, wherein the nipple extends longitudinally from the base, wherein the base extends longitudinally from the shield, wherein the base extends transversely from the nipple, wherein the nipple, base, and shield define a hollow lumen comprising a nipple portion of the lumen, a base portion of the lumen, and a shield portion of the lumen, wherein internal surface of the base defines the base portion of the lumen, wherein the shield has a posterior surface, and wherein the pacifier defines a pacifier mouth posterior to the nipple, the pacifier mouth having a mouth largest transverse dimension smaller than a largest transverse dimension of the internal surface of the base.

Clause 13. The pacifier according to clause 12, wherein the pacifier mouth is posterior to the base.

Clause 14. The pacifier according to clause 13, wherein the shield defines at least one said pacifier mouth posterior to the base on a posterior surface of the shield.

Clause 15. The pacifier, according to clause 13, wherein the shield posterior surface has a trough that circumferentially surrounds the pacifier mouth.

Clause 16. The pacifier, according to clause 13, wherein the shield posterior surface opens into a funnel shaped conduit defining the pacifier mouth and the shield posterior surface defines a trough which circumferentially encompassed the funnel shaped conduit.

Clause 17. The pacifier, according to clause 13, wherein internal surface of the shield defines the shield portion of the lumen, wherein the shield posterior surface has a shield opening, wherein a partition defining the pacifier mouth is within at least one of the hollow lumen portion of the base and the hollow lumen portion of the shield and said partition is attached to the internal surface of at least one of the base and the shield.

Clause 18. The pacifier, according to clause 13, wherein the posterior surface of the shield has a shield opening and a partition defining the pacifier mouth is within the shield opening and attached to the shield.

Clause 19. The pacifier according to clause 13, further comprising a hollow elongated handle having continuous sidewalls defining a handle portion of the hollow lumen, wherein the continuous sidewalls have a continuous perimeter, wherein the hollow elongated handle continuous sidewalls extend posteriorly from the shield, wherein the hollow elongated handle is integral with the shield, wherein the hollow elongated handle has an open posterior end.

Clause 20. The pacifier according to clause 19, wherein the hollow elongated handle is circular and circumferentially surrounds the pacifier mouth.

Clause 21. The pacifier, according to clause 19, wherein the shield portion of the lumen defines internal surface of the shield, wherein internal surface of the hollow elongated handle defines the hollow elongated handle portion of the lumen, wherein a partition defining the pacifier mouth is within at least one of the hollow lumen portion of the base, the hollow lumen portion of the shield, and the hollow lumen portion of the handle, and wherein said partition is attached to the internal surface of at least one of the base, the shield, and the handle.

Clause 22. The pacifier, according to clause 19, wherein the handle continuous sidewalls are cylindrical, further comprising a generally disc shaped member which defines the pacifier mouth, wherein the generally disc shaped member is within and attached to at least one of the shield and the base.

Clause 23. The pacifier, according to clause 13, wherein the shield, nipple, and base are integral as a single part body, further comprising a partition defining the pacifier mouth therein, said partition being located in and attached to at least one of the shield and a hollow elongated handle extending from the shield.

Clause 24. The pacifier, according to clause 23, wherein a snap locking ring is provided to lock in place the partition in contact with the main body of the shield.

Clause 25. The pacifier, according to clause 13, wherein the shield further comprises a partition attached to the shield to define a rear portion of the hollow lumen, wherein the partition defines the pacifier mouth, wherein a posterior surface of the shield includes a posterior surface of the partition.

Clause 26. The pacifier according to clause 25, wherein the partition tracks the shape of the shield.

Clause 27. The pacifier according to clause 26, further comprising a hollow elongated handle having continuous sidewalls defining a handle portion of the hollow lumen, wherein the continuous sidewalls have a continuous perimeter, wherein the hollow elongated handle extends posteriorly from the shield, wherein the hollow elongated handle is integral with the shield, wherein the handle portion of the hollow lumen is aligned with the mouth, wherein the hollow elongated handle has an open posterior end, wherein the partition tracks the shape of the hollow elongated handle.

Clause 28. The pacifier, according to clause 13, wherein the shield has a posterior surface, wherein the posterior surface of the shield has a shield opening and a partition defining the shield mouth is inserted into the shield opening and attached to the shield, wherein the partition defines a rear portion of the hollow lumen, wherein the shield has at least two air holes, wherein the partition has at least two air holes, wherein the air holes of the shield longitudinally align with the air holes of the partition.

Clause 29. The pacifier, according to clause 25, optionally further comprising a hollow elongated handle having continuous sidewalls defining a handle portion of the hollow lumen, wherein a passageway in communication with at least one said pacifier mouth extends transversely through the partition and at least one member of the group consisting of, the base, the shield and the handle; and at least one said pacifier mouth is on a sidewall of said at least one member of the group consisting of, the base, the shield and the handle.

Clause 30. A pacifier comprising a shield and a nipple and optionally a base, wherein the nipple and shield define a hollow lumen comprising a nipple portion of the lumen and a shield portion of the lumen and, if the optional base is present, a base portion of the lumen, wherein the nipple extends longitudinally from the shield or if the optional base is present the nipple extends longitudinally from the base, wherein if the optional base is present the base extends longitudinally from the shield, wherein the nipple portion of the lumen defines internal surface of the nipple, further comprising a hollow elongated handle having continuous sidewalls defining a handle portion of the hollow lumen, wherein the continuous sidewalls have a continuous perimeter, wherein the hollow elongated handle extends posteriorly from the shield, wherein the hollow elongated handle is integral with the shield, wherein the handle portion of the hollow lumen is aligned with the mouth, wherein the hollow elongated handle has an open posterior end, wherein the shield, nipple, and optional base are integral as a single part body.

Clause 31. The pacifier of clause 30, further comprising a partition located within and attached to at least one member of the group consisting of the shield and the hollow elongated handle.

Clause 32. The pacifier of clause 30, wherein the pacifier defines a pacifier mouth posterior to the nipple, the pacifier mouth having a mouth diameter smaller than a largest transverse dimension of an internal surface of a cavity in a neck of the nipple.

Clause 33. The pacifier of clause 32, wherein the pacifier mouth is defined by a partition located within and attached to at least one member of the group consisting of the shield and the hollow elongated handle.

Clause 34. The pacifier of clause 30, having the shield and nipple but no base, wherein the pacifier defines a pacifier mouth at a posterior end of the nipple, the pacifier mouth having a mouth largest transverse dimension smaller than a largest transverse dimension of the internal surface of the neck of the nipple.

Clause 35. The pacifier of clause 32, wherein the partition is attached to the single part body by ultrasonic welding or adhesive.

Clause 36. The pacifier, according to clause 32, wherein the shield has a posterior surface, wherein the posterior surface of the shield has a shield opening and the partition is inserted into the shield opening and attached to the shield, wherein the partition defines the closed rear portion of the hollow lumen, wherein the shield has at least two air holes, wherein the partition has at least two air holes, wherein the air holes of the shield longitudinally align with the air holes of the partition.

Clause 37. A pacifier comprising a shield, a base, and a nipple, wherein the nipple extends longitudinally from the base, wherein the base extends longitudinally from the shield, wherein the base extends transversely from the nipple, and optionally a hollow elongated handle extending from the shield;

wherein the nipple, base, and shield define a hollow lumen comprising a nipple portion of the lumen, a base portion of the lumen, and a shield portion of the lumen, wherein internal surface of the base defines the base portion of the lumen, wherein the shield has a posterior surface, and wherein the shield, nipple, and base are integral as a single part body, further comprising a partition located in and attached to at least one of the shield and the hollow elongated handle extending from the shield, said partition defining said hollow lumen to have a closed rear portion having no openings therethrough.

Clause 38. A pacifier comprising a shield and a nipple and optionally a base, wherein the nipple has a posterior neck portion and a distal head end portion, wherein the nipple and shield define a hollow lumen comprising a nipple portion of the lumen and a shield portion of the lumen and, if the optional base is present, a base portion of the lumen, wherein the nipple extends longitudinally from the shield or if the optional base is present the nipple extends longitudinally from the base, wherein if the optional base is present the base extends longitudinally from the shield, wherein the nipple portion of the lumen defines internal surface of the nipple, wherein the shield, nipple, and optional base are integral as a single part body, further comprising a handle which extends posteriorly from the shield, wherein the handle is integral with the shield, wherein the pacifier defines a pacifier mouth within a posterior end of the nipple and/or posterior to the nipple, the pacifier mouth having a mouth diameter smaller than a largest transverse dimension of an internal surface of the posterior neck portion of the nipple.

It is intended the invention be limited only by the claims appended hereto.

The invention claimed is:

1. A pacifier comprising:

a shield, a base, and a nipple, the nipple comprising a stem for insertion into an infant's mouth and comprising a closed distal end, the stem having longitudinal sidewalls, the shield, the base, and the nipple being longitudinally aligned, the base extending longitudinally from the shield, the nipple extending longitudinally from the base;

the base having a top wall, the top wall of the base having a slope line which intersects a longitudinal axis of the stem at an angle β (beta) of 55 to 120 degrees, wherein the nipple, base, and shield define a hollow lumen comprising a nipple portion of the lumen, a base portion of the lumen, and a shield portion of the lumen, further comprising a hollow elongated handle having continuous sidewalls defining a handle lumen having a continuous perimeter, the hollow elongated handle extending posteriorly from the shield, wherein the hollow elongated handle is integral with the shield, the hollow elongated handle having an open posterior end;

wherein the handle, the shield, the base, and the nipple are a uni-molded pacifier single unitary piece, wherein the base of the uni-molded pacifier single unitary piece defines a posterior pacifier mouth having a mouth diameter smaller than an internal diameter of the base portion of the lumen anterior to the posterior pacifier mouth.

2. The pacifier of claim 1, wherein the nipple has a neck portion and a distal head portion, wherein the nipple portion of the lumen has a nipple neck portion of the lumen and a nipple distal head portion of the lumen, wherein the mouth diameter of the posterior pacifier mouth is smaller than a largest transverse dimension of an internal surface of the nipple neck portion of the lumen.

3. The pacifier, according to claim 1, wherein the handle, the shield, the base, and the nipple are the uni-molded pacifier single unitary piece of silicone, wherein the pacifier consists of silicone rubber.

4. A pacifier comprising a shield, a base, and a nipple, wherein the nipple extends longitudinally from the base, wherein the base extends longitudinally from the shield, wherein the base extends transversely from the nipple, wherein the nipple, the base, and the shield define a hollow lumen comprising a nipple portion of the lumen, a base portion of the lumen, and a shield portion of the lumen, wherein the shield, the base, and the nipple are a uni-molded pacifier single unitary piece, wherein internal surface of the base of the uni-molded pacifier single unitary piece defines the base portion of the lumen, wherein the shield has a posterior surface, and wherein an internal surface of the base of the uni-molded pacifier single unitary piece defines a posterior pacifier mouth posterior to the nipple, the posterior pacifier mouth having a mouth diameter defined by the internal surface of the base of the uni-molded pacifier single unitary piece smaller than a largest transverse dimension of the internal surface of the base of the uni-molded pacifier single unitary piece, wherein the base portion of the lumen tapers posteriorly from the largest transverse dimension to the mouth diameter of the posterior pacifier mouth.

5. The pacifier, according to claim 4, wherein internal surface of the shield defines the shield portion of the lumen, wherein the shield posterior surface has a shield opening.

6. The pacifier according to claim 4, further comprising a hollow elongated handle having continuous sidewalls defining a handle portion of the hollow lumen, wherein the continuous sidewalls have a continuous perimeter, wherein the hollow elongated handle continuous sidewalls extend posteriorly from the shield, wherein the hollow elongated handle is integral with the shield, wherein the hollow elongated handle has an open posterior end.

7. The pacifier according to claim 6, wherein the hollow elongated handle is circular and circumferentially surrounds the pacifier mouth, wherein the handle, the shield, the base, and the nipple are the uni-molded pacifier single unitary piece.

8. The pacifier, according to claim 6, wherein the shield portion of the lumen defines an internal surface of the shield, wherein an internal surface of the hollow elongated handle defines the handle portion of the lumen.

9. The pacifier, according to claim 6, wherein the handle continuous sidewalls are cylindrical.

10. The pacifier according to claim 6, wherein the handle portion of the hollow lumen is aligned with the mouth.

11. The pacifier, according to claim 4, wherein the posterior surface of the shield has a shield opening.

12. The pacifier, according to claim 4, further comprising a hollow elongated handle having continuous sidewalls defining a handle portion of the hollow lumen.

13. The pacifier according to claim 4, wherein the pacifier is made of silicone rubber.

14. The pacifier according to claim 4, wherein the nipple has a closed distal end.

15. A pacifier comprising a shield and a nipple and optionally a base, wherein the nipple and the shield define a hollow lumen comprising a nipple portion of the lumen and a shield portion of the lumen and, if the optional base is present, a base portion of the lumen, wherein the nipple extends longitudinally from the shield or if the optional base is present the nipple extends longitudinally from the base, wherein if the optional base is present the base extends longitudinally from the shield, wherein the nipple portion of the lumen defines internal surface of the nipple, further comprising a hollow elongated handle having continuous sidewalls defining a handle portion of the hollow lumen, wherein the continuous sidewalls have a continuous perimeter, wherein the hollow elongated handle extends posteriorly from the shield, wherein the hollow elongated handle is integral with the shield, wherein the nipple has a neck portion and a distal head portion, wherein the nipple portion of the lumen has a nipple neck portion of the lumen and a nipple distal head portion of the lumen, wherein the pacifier defines a posterior pacifier mouth that is posterior to the nipple, wherein a mouth diameter of the posterior pacifier mouth is smaller than a largest transverse dimension of an internal surface of the nipple neck portion of the lumen, wherein the handle portion of the hollow lumen is aligned with the posterior pacifier mouth, wherein the hollow elongated handle has an open posterior end, wherein the shield, nipple, and optional base are integral as a single part body that is a uni-molded pacifier single unitary piece, wherein an inner surface of the shield or the base of the uni-molded pacifier single unitary piece defines the posterior pacifier mouth, wherein the uni-molded pacifier single unitary piece defines the base portion of the lumen or the shield portion of the lumen to taper posteriorly from a largest transverse dimension of the base portion of the lumen or the shield portion of the lumen to the mouth diameter of the posterior pacifier mouth.

16. The pacifier of claim 15, wherein the pacifier mouth has a largest transverse dimension at most equal to the largest transverse dimension of the internal surface of the nipple neck portion of the lumen.

17. The pacifier of claim 15, having the shield and the nipple but no base.

18. The pacifier according to claim 15, wherein the largest transverse dimension of the shield portion of the lumen is larger than the largest transverse dimension of the base portion of the lumen.

19. The pacifier according to claim 15, wherein the nipple has a closed distal end.

20. A pacifier comprising a shield and a nipple and optionally a base, wherein the nipple has a posterior neck portion and a distal head end portion, wherein the nipple and the shield define a hollow lumen comprising a nipple portion of the lumen and a shield portion of the lumen and, if the optional base is present, a base portion of the lumen, wherein the nipple extends longitudinally from the shield or if the optional base is present the nipple extends longitudinally from the base, wherein if the optional base is present the base extends longitudinally from the shield, wherein the nipple portion of the lumen defines an internal surface of the nipple, wherein the shield, the nipple, and the optional base are integral as a single part body that is a uni-molded pacifier single unitary piece, further comprising a handle which extends posteriorly from the shield, wherein the handle is integral with the shield, wherein the pacifier uni-molded pacifier single unitary piece defines a posterior pacifier mouth posterior to the nipple, the posterior pacifier mouth having a mouth diameter smaller than a largest transverse dimension of an internal surface of the posterior neck portion of the nipple, wherein the nipple has a closed nipple distal end, wherein inner surface of the shield or the base of the uni-molded pacifier single unitary piece defines the pacifier mouth, wherein the uni-molded pacifier single unitary piece defines the base portion of the lumen or the shield portion of the lumen to taper posteriorly from a largest transverse dimension of the base portion of the lumen or the shield portion of the lumen to the mouth diameter of the posterior pacifier mouth.

21. The pacifier according to claim 20, wherein the base defines the base portion of the lumen to have a largest transverse direction equal to a largest transverse dimension of the internal surface of the nipple which tapers in a posterior direction to a smaller transverse dimension of the base.

22. The pacifier according to claim 20, wherein the shield defines the shield portion of the lumen to have a largest transverse direction equal to a largest transverse dimension of the internal surface of the nipple which tapers in a posterior direction to a smaller transverse dimension of the shield.

23. The pacifier according to claim 20, wherein the largest transverse dimension of the shield portion of the lumen is larger than a largest transverse dimension of the base portion of the lumen.

24. A pacifier comprising a shield and a nipple and optionally a base, wherein the nipple has a posterior neck portion and a distal head end portion, wherein the nipple and the shield define a hollow lumen comprising a nipple portion of the lumen and a shield portion of the lumen and if the optional base is present a base portion of the lumen, wherein the nipple extends longitudinally from the shield or if the optional base is present the nipple extends longitudinally from the base, wherein if the optional base is present the base extends longitudinally from the shield, wherein the nipple portion of the lumen defines an internal surface of the nipple, wherein the shield, the nipple, and if the optional base is present are integral as a single part body that is a uni-molded pacifier single unitary piece, wherein the shield is posterior to the nipple and if the base is present the base is posterior to the nipple, further comprising a handle which extends posteriorly from the shield, wherein the handle is integral with the shield, wherein the pacifier uni-molded pacifier single unitary piece defines the a posterior pacifier mouth within the shield or the base, the posterior pacifier mouth having a mouth diameter smaller than a largest transverse dimension of an internal surface of the posterior neck portion of the nipple, wherein inner surface of the shield or the base of the uni-molded pacifier single unitary piece defines the pacifier mouth, wherein the uni-molded pacifier single unitary piece defines the base portion of the lumen or the shield portion of the lumen to taper posteriorly from a largest transverse dimension of the base portion of the lumen or the shield portion of the lumen to the mouth diameter of the posterior pacifier mouth.

25. The pacifier according to claim 24, wherein the nipple has a closed distal end.

* * * * *